US010607446B2

(12) United States Patent
Brunet de Courssou et al.

(10) Patent No.: US 10,607,446 B2
(45) Date of Patent: Mar. 31, 2020

(54) METHOD AND SYSTEM FOR TIME GAMING WITH SKILL WAGERING OPPORTUNITIES

(71) Applicant: IGT, Las Vegas, NV (US)

(72) Inventors: Thierry Brunet de Courssou, Broome (AU); Cameron Anthony Filipour, Las Vegas, NV (US); Adam Singer, Las Vegas, NV (US); Alexander Popovich, Henderson, NV (US)

(73) Assignee: IGT, Las Vegas, NV (US)

( * ) Notice: Subject to any disclaimer, the term of this patent is extended or adjusted under 35 U.S.C. 154(b) by 112 days.

(21) Appl. No.: 15/367,877

(22) Filed: Dec. 2, 2016

(65) Prior Publication Data

US 2017/0084124 A1 Mar. 23, 2017

Related U.S. Application Data

(63) Continuation of application No. 12/122,626, filed on May 16, 2008, now Pat. No. 9,514,596, which is a (Continued)

(51) Int. Cl.
*G07F 17/32* (2006.01)
*A63F 9/24* (2006.01)

(52) U.S. Cl.
CPC ..... *G07F 17/3258* (2013.01); *G07F 17/32* (2013.01); *G07F 17/3209* (2013.01); (Continued)

(58) Field of Classification Search
CPC . A63F 13/10; A63F 9/24; G07F 17/32; G07F 17/34; G07F 17/3262; G07F 17/3295; G06F 21/10; H04L 9/32
See application file for complete search history.

(56) References Cited

U.S. PATENT DOCUMENTS 4,363,485 A 12/1982 Edwall
4,593,904 A 6/1986 Graves
(Continued)

FOREIGN PATENT DOCUMENTS

WO WO 01/41892 6/2001

OTHER PUBLICATIONS

European Office Action dated Jul. 14, 2016 for European Application No. 07 812 240.5 (7pages).
(Continued)

*Primary Examiner* — Steven J Hylinski
(74) *Attorney, Agent, or Firm* — Neal, Gerber & Eisenberg LLP

(57) ABSTRACT

A gaming system and method which includes determining a skill level of a player, determining, based on the determined skill level of the player, a return-to-player percentage to employ for a play of a game, wherein a first return-to-player percentage is determined when the skill level is a first skill level and a second, different return-to-player percentage is determined when the skill level is a second, different skill level, causing a display of the play of the game for the player in accordance with the determined return-to-player percentage, the play of the game associated with receipt of at least one skill-based input, and responsive to a score increase event that occurs in association with the play of the game, modifying a score of the player and causing a display of the modified score, wherein the score of the player is separate from a credit balance of the player.

20 Claims, 20 Drawing Sheets

Related U.S. Application Data continuation-in-part of application No. 11/457,137, filed on Jul. 12, 2006, now Pat. No. 7,722,461.

(52) U.S. Cl.
CPC ..... *G07F 17/3211* (2013.01); *G07F 17/3223* (2013.01); *G07F 17/3262* (2013.01); *G07F 17/3267* (2013.01); *G07F 17/3295* (2013.01); *A63F 9/24* (2013.01)

(56) References Cited

U.S. PATENT DOCUMENTS 4,695,053 A 9/1987 Vazquez, Jr. et al.
5,149,094 A 9/1992 Tastad
5,265,874 A 11/1993 Dickinson et al.
5,280,909 A 1/1994 Tracy
5,290,033 A 3/1994 Bittner et al.
5,342,049 A 8/1994 Wichinsky et al.
5,354,202 A 10/1994 Moncrief et al.
5,718,632 A 2/1998 Hayashi
5,743,523 A 4/1998 Kelly et al.
5,816,913 A 10/1998 Nakamura
5,823,873 A 10/1998 Moody
5,823,879 A 10/1998 Goldberg et al.
5,890,963 A 4/1999 Yen
5,910,046 A 6/1999 Wada et al.
6,012,983 A 1/2000 Walker et al.
6,019,374 A 2/2000 Breeding
6,048,269 A 4/2000 Burns et al.
6,050,895 A 4/2000 Luciano, Jr. et al.
6,077,163 A 6/2000 Walker et al.
6,146,273 A 11/2000 Olsen
6,171,186 B1 1/2001 Kurosawa et al.
6,179,713 B1 1/2001 James et al.
6,182,086 B1 1/2001 Lomet et al.
6,244,957 B1 6/2001 Walker et al.
6,267,669 B1 * 7/2001 Luciano, Jr. ..... A63F 13/10 273/269
6,283,474 B1 9/2001 de Keller
6,409,597 B1 6/2002 Mizumoto
6,413,160 B1 7/2002 Vancura
6,425,823 B1 7/2002 Byrne
6,428,413 B1 8/2002 Carlson
6,517,433 B2 2/2003 Loose et al.
6,522,312 B2 2/2003 Ohshima et al.
6,572,473 B1 6/2003 Baerlocher
6,645,077 B2 11/2003 Rowe
6,652,378 B2 11/2003 Cannon et al.
6,666,765 B2 12/2003 Vancura
6,746,016 B2 6/2004 Perrie et al.
6,749,510 B2 6/2004 Giobbi
6,752,717 B2 6/2004 Vancura
6,761,632 B2 7/2004 Bansemer et al.
6,761,636 B2 7/2004 Chung et al.
6,780,103 B2 8/2004 Bansemer et al.
6,811,482 B2 11/2004 Letovsky
6,852,027 B2 2/2005 Kaminkow
6,863,606 B1 3/2005 Berg et al.
6,918,830 B2 7/2005 Baerlocher
6,921,331 B2 7/2005 Gatto et al.
6,942,568 B2 9/2005 Baerlocher
6,970,728 B2 11/2005 Chenoweth et al.
6,984,174 B2 1/2006 Cannon et al.
6,988,732 B2 1/2006 Vancura
7,056,210 B2 6/2006 Bansemer et al.
7,070,506 B1 7/2006 Ropp et al.
7,073,793 B2 7/2006 Vancura
7,077,744 B2 7/2006 Cannon
D535,338 S 1/2007 Linard et al.
7,156,741 B2 1/2007 Hornik et al.
7,175,521 B2 2/2007 McClintic
7,175,524 B2 2/2007 Bansemer et al.
7,217,187 B2 5/2007 Vancura
7,234,700 B2 6/2007 Vancura
7,291,070 B2 11/2007 Gatto et al.
7,326,115 B2 2/2008 Baerlocher
7,371,173 B2 5/2008 Gatto et al.
7,572,182 B2 8/2009 Vancura
7,686,303 B2 3/2010 Kaminkow et al.
7,789,749 B2 9/2010 Bansemer et al.
7,846,015 B2 12/2010 Bansemer et al.
7,967,674 B2 6/2011 Baerlocher
2002/0128065 A1 9/2002 Chung et al.
2002/0147040 A1 10/2002 Walker et al.
2003/0027619 A1 * 2/2003 Nicastro, Sr. ..... G07F 17/32 463/16
2003/0064800 A1 4/2003 Jackson et al.
2003/0092477 A1 5/2003 Luciano et al.
2003/0092484 A1 5/2003 Schneider et al.
2003/0171140 A1 9/2003 Gatto et al.
2003/0186734 A1 10/2003 LeMay et al.
2003/0211881 A1 11/2003 Walker et al.
2004/0102238 A1 5/2004 Taylor
2004/0219968 A1 11/2004 Fiden et al.
2004/0235561 A1 11/2004 Marshall et al.
2005/0148377 A1 7/2005 Goldberg et al.
2005/0181853 A1 8/2005 Baerlocher
2005/0192087 A1 9/2005 Friedman et al.
2005/0202864 A1 * 9/2005 Duhamel ..... G07F 17/32 463/16
2006/0019743 A1 1/2006 Roemer
2006/0025201 A1 2/2006 Van Asdale
2006/0052162 A1 3/2006 Soukup et al.
2006/0079321 A1 4/2006 Walker et al.
2006/0189376 A1 8/2006 Hornik et al.
2006/0194630 A1 8/2006 Pellegrini et al.
2006/0281509 A1 * 12/2006 Arias-Vargas ..... G07F 17/32 463/8
2007/0032286 A1 2/2007 Muir
2007/0129128 A1 6/2007 McClintic
2007/0129144 A1 6/2007 Katz et al.
2007/0142108 A1 6/2007 Linard et al.
2007/0173328 A1 7/2007 Edgren et al.
2008/0009341 A1 1/2008 Walker et al.
2008/0064491 A1 3/2008 Taylor
2008/0076519 A1 * 3/2008 Chim ..... G07F 17/32 463/20
2008/0108404 A1 * 5/2008 Iddings ..... G07F 17/32 463/16
2008/0311980 A1 12/2008 Cannon
2009/0011824 A1 * 1/2009 Englman ..... G07F 17/3265 463/25
2009/0049542 A1 * 2/2009 DeYonker ..... G06F 21/10 726/18
2009/0061999 A1 * 3/2009 Popovich ..... G07F 17/32 463/26
2011/0218024 A1 9/2011 Baerlocher

OTHER PUBLICATIONS

Intel Corporation, Intel Platform Security Division, "The Intel Random Number Generator", pp. 1-12, 1999.

International Preliminary Report on Patentability dated Jan. 13, 2005, in related International Application No. PCT/US04/28935, filed Sep. 2, 2004.

International Preliminary Report on Patentability dated Jan. 22, 2009 in related International Application PCT/US2007/071813 (8 pages).

International Preliminary Report on Patentability dated Nov. 2010 in PCT/US2009/044070 (7 pages).

International Search Report dated Aug. 2, 2005, in related International Application No. PCT/US04/28935, filed Sep. 2, 2004.

International Search Report and Written Opinion of the International Searching Authority dated Jul. 10, 2009 in corresponding PCT application PCT/US09/44070.

International Search Report in corresponding PCT case PCT/US07/71813, dated Oct. 2, 2008.

McGehee, Brad, "An Introduction to SQL Clustering" [online], Jun. 24, 2001, [retrieved Jun. 29, 2005, from http://www.sql-server-performance.com/clustering_introllasp.

(56) References Cited

OTHER PUBLICATIONS

Office Action for related U.S. Appl. No. 12/749,235, dated May 24, 2013 (13 pages).
Office Action for related U.S. Appl. No. 12/749,235, dated Feb. 28, 2012 (12 pages).
Office Action dated Aug. 18, 2008 in parent U.S. Appl. No. 11/457,137, filed Jul. 12, 2006.
Written Opinion of the International Searching Authority in corresponding PCT case PCT/US07/71813, dated Oct. 2, 2008.
Written Opinion dated Aug. 2, 2005, in related International Application No. PCT/US04/28935, filed Sep. 2, 2004.

* cited by examiner

METHOD AND SYSTEM FOR TIME GAMING WITH SKILL WAGERING OPPORTUNITIES

PRIORITY CLAIM

This patent application is a continuation of, and claims priority to and the benefit of, U.S. patent application Ser. No. 12/122,626, which was filed on May 16, 2008, which is a continuation-in-part of, and claims priority to and the benefit of, U.S. patent application Ser. No. 11/457,137, which was filed on Jul. 12, 2006, and issued as U.S. Pat. No. 7,722,461 on May 25, 2010, the entire contents of each of which are incorporated herein by reference.

BACKGROUND

1. Field of the Invention

This invention relates generally to the field of electronic gaming terminals available in casinos and other legal places.

2. Description of the Prior Art and Related Information

Electronic gaming machines available in casinos and other legal places are games of chance whereby the player repetitively tries his luck to win prizes. The player purchases an amount of credit to play by transferring monetary value into the gaming machine or into the networked gaming system using coins, banknotes, vouchers or any other form of financial instrument. In exchange for his money, the player is given an electronic credit on a local gaming machine or alternatively on a networked gaming system by way of a player account managed on a server. Each time the player plays a game, his credit balance is debited of the amount he wishes to wager. Depending on the local game regulation, the wager amount is either hardwired into the gaming machine or selectable by the user prior to playing a game. The play-and-debit scenario is typically repeated monotonously until the player's credit is used up or until a prize is won. The prize value is derived from numbers drawn randomly, an outcome prize matrix and the wager amount.

SUMMARY

According to an embodiment thereof, the present invention is a method of determining rewards due to a player playing a regulated gaming machine. Such a method may include steps of providing, in the regulated gaming machine, an arcade-type or console-type game, modified such that player interaction with selected ones of a plurality of assets within the game give rise to wagering opportunities; accepting funds from a player of the regulated gaming machine and using a first portion of the funds to fund a progressive jackpot to be awarded after a predetermined point in time and using a second portion of the funds to purchase a game play contract, the game play contract enabling the player to play the game, for a duration that is a function of the second portion of the funds, and with an initial credit balance; keeping score during game play of the game and updating the score whenever the player interacts with the assets within the game for the duration; initiating a wager whenever the player successfully interacts with any of the selected assets within the game; randomly determining an outcome of the wager, an amount of the wager being a function of a time elapsed since a last wager was placed and updating the credit balance depending upon the outcome of the wager; when the predetermined duration is over, determining whether the updated score matches or exceeds a pre-stored high score, and, if so, establishing the updated score as the new high score, and at or after the predetermined point in time, awarding at least a portion of the progressive jackpot to the player if the player's updated score was established as the high score and has not been exceeded by the predetermined point in time.

According to further embodiments, the method may further include a recognition step in which at least the player having earned the high score is recognized. The providing step may be carried out with the duration being visually represented to the player as an onscreen timer meter. The method may further include a step of providing the credit balance onscreen as a credit meter. The method may further include a step of visually presenting the wagers to the player using a last win meter to show a win size of the most recent wager and a total win meter to show cumulative credits won during the duration. The accepting step may be carried out with the predetermined period of time being one of hourly, daily, weekly, monthly, or yearly, or any other time period. The providing step may be carried out with the console-type or arcade-type of game being a pinball game, an automobile racing game, a 2D horizontal scrolling game, a first person shooter and/or a 3D maze game, for example. The providing step may be carried out with the console-type or arcade-type of game being an outer-space themed game in which the player attempts to destroy spacecrafts or aliens. The method may further include issuing a jackpot redemption ticket to the player when the player's updated score is established as the high score after the duration. The method may further include rewarding the player with at least a portion of the progressive jackpot if the player's high score is not or has not been exceeded by the predetermined point in time. The method may also include a step of reading the jackpot redemption ticket by, for example, the regulated gaming machine or a gaming kiosk (or functionally equivalent device) to determine whether a holder jackpot redemption ticket should be awarded at least a portion of the progressive jackpot. The method may further include a step of accepting input in a website from the player, the input corresponding to information printed on the jackpot redemption ticket, the website being configured to inform the player, based upon the provided input, whether the player has won at least a portion of the progressive jackpot.

According to another embodiment thereof, the present invention is a method of providing a game for a regulated gaming machine. The method may include steps of providing an existing console-type game or arcade-type game, the provided game being configured to keep and update a score during game play thereof and including a plurality of assets appearing onscreen during game play; modifying the provided game such that: a session of the provided game may be initiated on the gaming machine by a player purchasing playing time with funds, an amount of playing time and an amount of credits being a function of an amount of the funds; interaction by the player with at least one of the plurality of assets appearing onscreen during the game session places a wager whenever the score increases, an amount of the wager being a function of a time elapsed since a last wager was placed; an outcome of the wager is determined randomly; a percentage of the player's funds is used to fund a progressive jackpot to be awarded after a predetermined point in time; when the playing time is over, the game determines if the updated score matches or exceeds a pre-stored high score, and, if so, the game establishes the updated score as a new high score, and at or after the predetermined point in time, the game awards at least a portion of the progressive jackpot to the player if the player's updated score was established as the high score and has not been exceeded by the predetermined point in time, and loading the modified game into the regulated gaming machine.

The modifying step may further modify the provided game such that a clock meter appears onscreen to visually represent a remaining amount of playing time. The modifying step may further modify the provided game such that a credit meter appears onscreen to visually represent the player's credit balance. The modifying step may be carried out such that a last win meter appears onscreen to visually represent a win size of a most recent wager and such that a total win meter appears onscreen to visually represent cumulative credits won. The modifying step may be carried out such that jackpot redemption tickets are issued to players whose score equals or exceeds a current high score. The method may further include a step of configuring the regulated gaming machine to read the jackpot redemption tickets, to inform players if their high score has been subsequently exceeded and to pay players if their high score has not been exceeded and the predetermined point in time has passed.

Yet another embodiment of the present invention is a method, comprising providing a regulated gaming machine; providing a console-type or arcade-type game that includes a plurality of assets configured for player interaction, the game being configured to keep score during game play thereof, configuring the game to run on the regulated gaming machine and to require a purchase of a game play contract for a predetermined amount of money; using a portion of the predetermined amount of money to fund a progressive jackpot that is awarded at or after a predetermined point in time and using a remaining portion of the predetermined amount of money to enable game play on the game for a predetermined duration; configuring selected ones of the plurality of assets such that player interaction therewith during game play gives rise to a wager, an outcome of which is determined randomly and awarding credits when the randomly determined outcome is a reward generating outcome; tracking and updating the score during game play and awarding at least a portion of the progressive jackpot to a player whose updated score at the end of the predetermined duration is a highest score that has not been exceeded by the predetermined point in time. The asset configuring step may be carried out such that an amount of the wager is a function of a time elapsed since a last wager was placed.

Yet another embodiment of the present invention is a regulated game, comprising a plurality of reward generating assets configured such that successful player interactions therewith increase a score and give rise to wagers whose outcomes are determined randomly, an amount of the wager being a function of a time elapsed since a last wager was placed, the regulated game being configured such that a predetermined duration of game play time thereon may be purchased for a predetermined amount of money, a first portion thereof funding the wagers and a second portion thereof funding a progressive jackpot to be awarded to a player having earned a highest score that has not been exceeded by a predetermined point in time, the regulated game being further configured to award credits when the randomly determined outcome is a reward generating outcome and to show both the score and awarded credits. The game may be configured such that players having a higher level of skill will, on average, interact successfully with the plurality of assets more frequently than comparatively less skilled players and earn a higher score.

DETAILED DESCRIPTION

Reference will now be made in detail to the construction and operation of preferred implementations of the present invention illustrated in the accompanying drawings. The following description of the preferred implementations of the present invention is only exemplary of the invention. The present invention is not limited to these implementations, but may be realized by other implementations.

Figure 1:
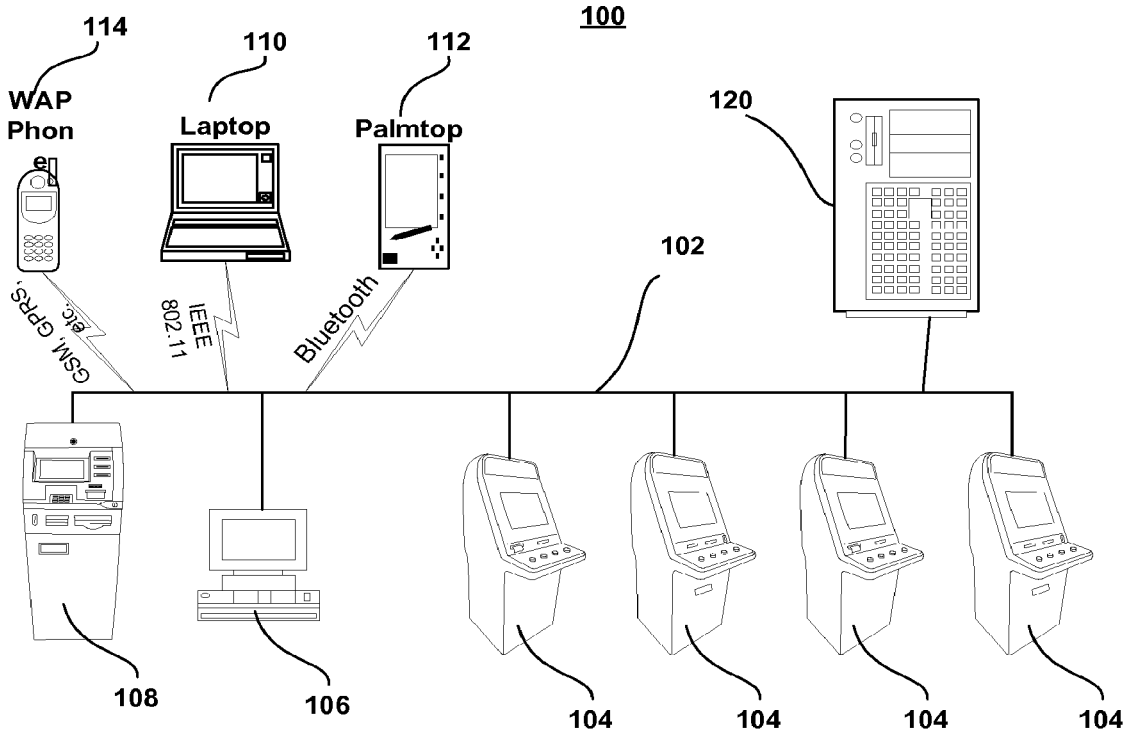
FIG. 1 is an overview diagram of an exemplary cashless gaming system, in accordance with an embodiment of the present invention.

FIG. 1 illustrates a gaming system 100 according to an embodiment of the present invention. The gaming system 100 may include a plurality of gaming terminals 104, a cashier terminal 106 or an automatic cashier 108, a central system 120, all communicating via a wired or wireless network 102. Wireless entry devices such as laptops 110 using 802.11, palmtops 112 using Bluetooth or 802.11, or WAP phones may advantageously be used in some premises for operators to consult and credit the game session meters.

The gaming terminals may be of the traditional cash-in type comprising coins and/or notes acceptors and coins and/or notes dispensers, or alternatively, may be of the cashless type.

Figure 2:
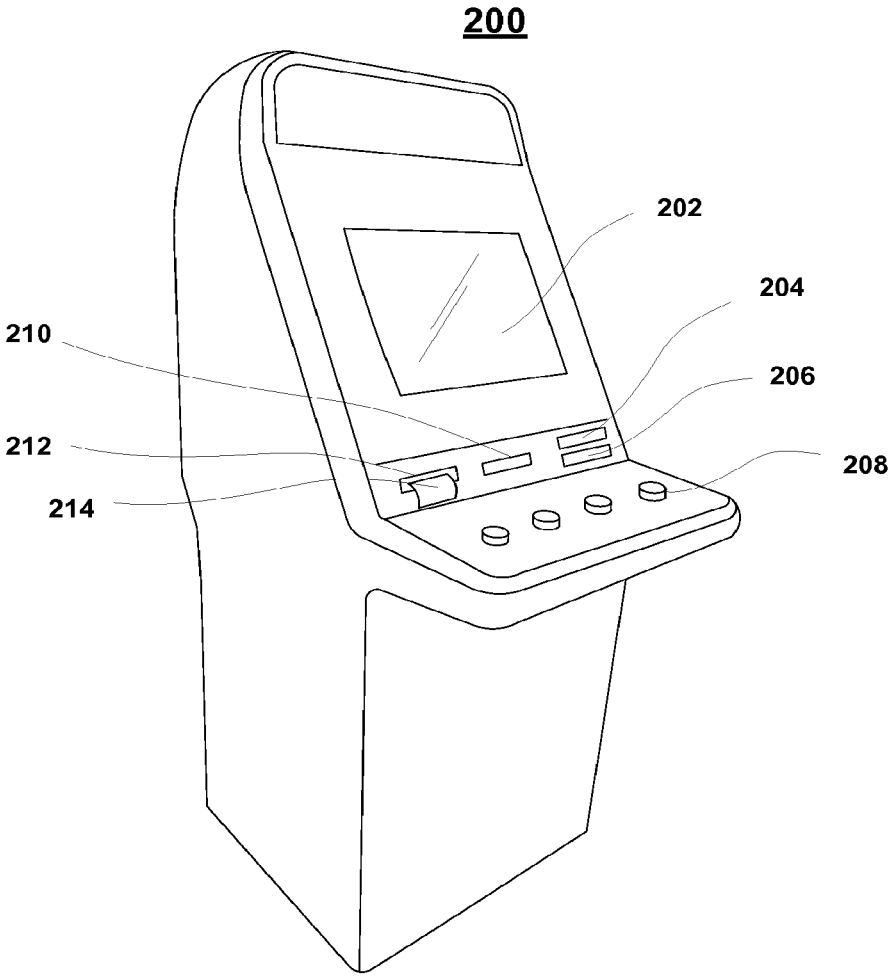
FIG. 2 is a view depicting an exemplary cashless game terminal in accordance with an embodiment of the present invention.

FIG. 2 illustrates an exemplary cashless gaming machine 200 that does not accept or redeem cash. It is to be understood that the gaming machine 200 is but one possible implementation of such a cashless gaming machine and that the present invention is not limited thereto. For cashless operation, the gaming terminal is equipped with means of capturing the encoded information associated with a cashless instrument submitted. The cashless instrument may be a physical portable instrument such as: a paper voucher comprising printed codes; a strong paper ticket comprising printed codes and encoded magnetic codes; a rigid ID card comprising printed codes, magnetic codes or optical codes; a secure contact or contact-less electronic ID device comprising sophisticated electronic (a smart card or a smart USB dongle); or alternatively, a user ID and password to be typed or spoken, or alternatively again advanced biometric features (finger print, voice recognition, face recognition). The information captured from a cashless instrument is processed in order to derive a pointer to a location containing the necessary computer data to identify and validate the cashless instrument. The information captured from a cashless instrument may contain an encrypted signature (or hash) to ensure that the information has not been maliciously modified. The cashless instrument allows to derive a valid "identifier code" that is used by the software to execute the appropriate transactions to emulate the use of real cash for the cashless instrument submitted. The cashless instrument is thus denoted "ID instrument" hereafter. The ID instrument may be capable of storing additional information when accessed by a device, or alternatively be replaced by a new one (i.e. a newly printed ticket). The gaming machine ID device(s) accepting the ID instrument submitted may include a magnetic card reader 204, a SmartCard reader and writer 206, a barcode reader 210, a ticket printer 212, a biometric reader (finger print, voice identification, head identification, etc.), a touch-screen 202, keyboard or keypad to enable players to enter a PIN (Personal Identification Number). The gaming machine identification device(s) may further include an ID token reader to read other forms of advanced ID devices such as ID buttons, USB ID dongles, ID key-chains (such as disclosed, for example in commonly assigned US design patent entitled "Personal Communicator and Secure ID Device" patent number D441,765 issued on May 8, 2001) as well as secure communication means for securely communicating with, for example, personal wallets, hand held PCs or computer wrist-watch via infra red, magnetic field, capacitive charges or RF (Bluetooth, IEEE 802.11, etc.) for player identification purposes. A printer 212 may print bar-coded tickets 214 that can be read by a barcode reader 210.

Figure 3:
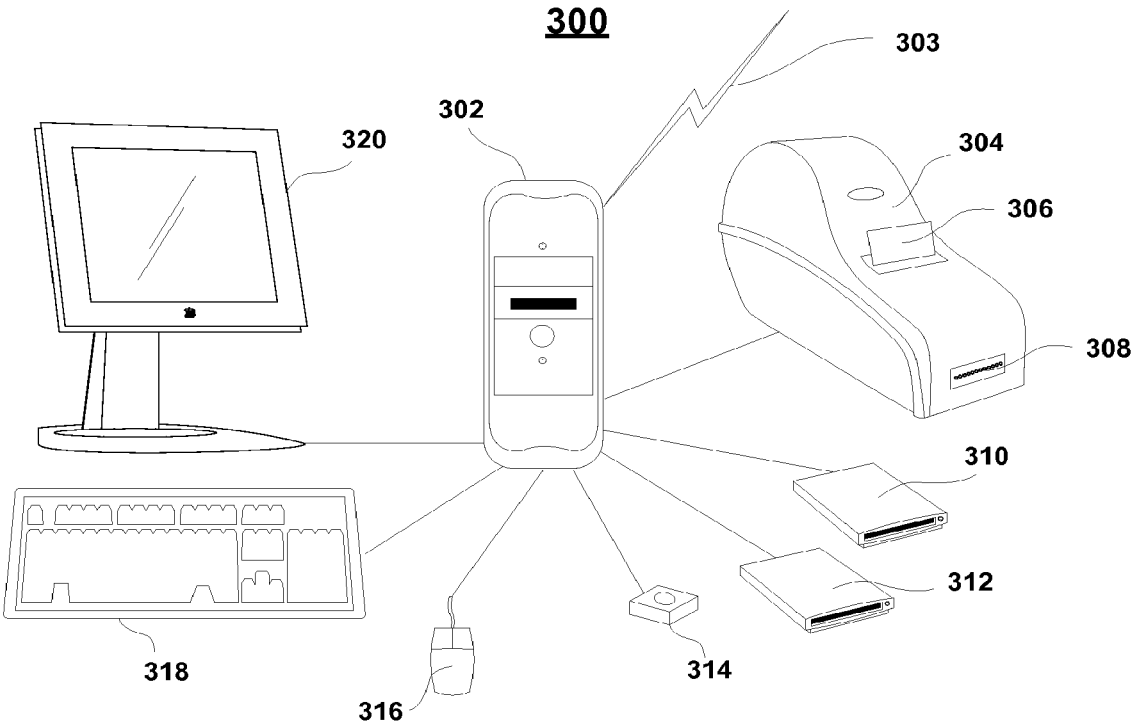
FIG. 3 is a view depicting an exemplary cashier terminal in accordance with an embodiment of the present invention.

FIG. 3 illustrates a cashier terminal 300, according to an embodiment of the present invention. The terminal may include a computer 302 connected via wired or wireless link 303 to the network 102 and to a ticket printer 304. The ticket printer 304 may include an integrated printer for printing tickets or receipts 306 that include a human and/or machine readable code imprinted thereon and code reader 308 for reading the code(s) imprinted on the ticket 306. The cashier terminal may also include, for example, a magnetic card reader 310, a SmartCard reader 312, a biometric reader 314 (such as a fingerprint reader, for example), a display 320 and input devices such as a keyboard 318 and/or a mouse 316. The cashier terminal is controlled by an operating system capable of secure network communication such as Microsoft Windows, embedded XP or Linux, for example.

Figure 4:
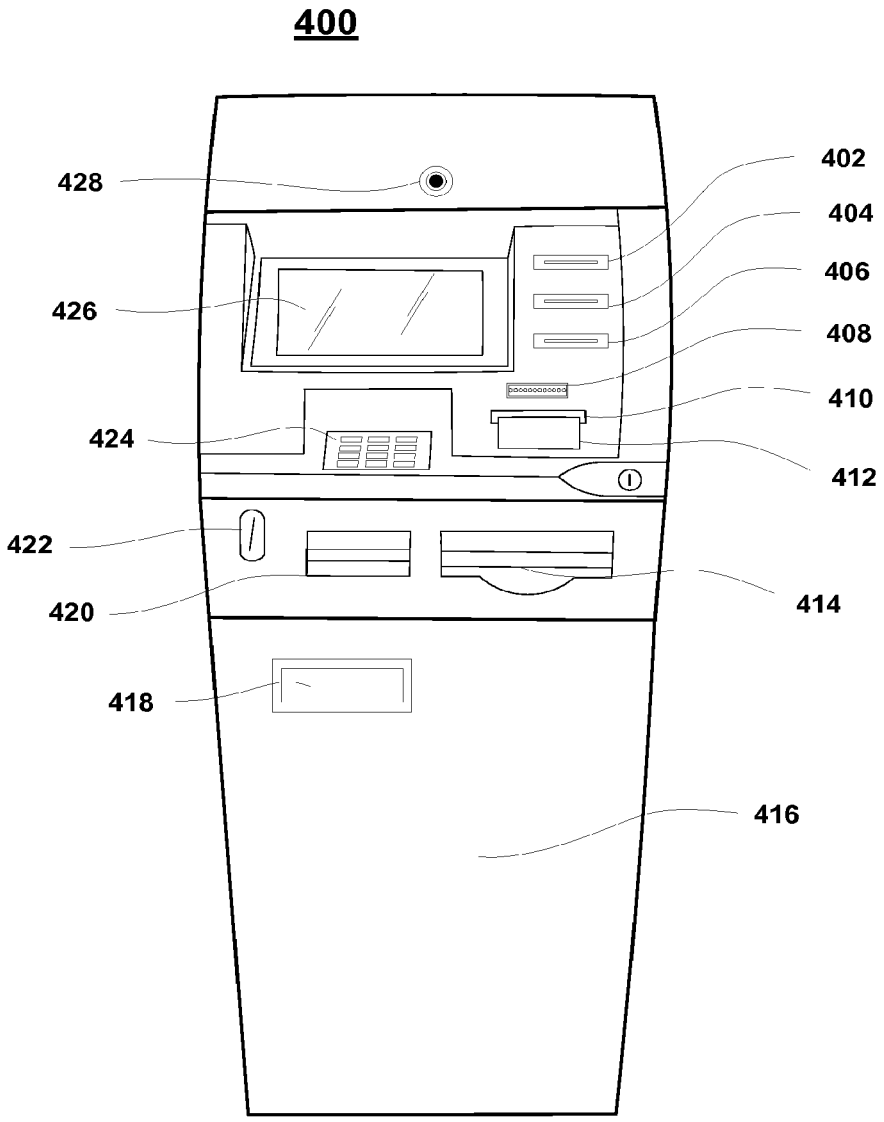
FIG. 4 is a view depicting an exemplary automated cashier in accordance with an embodiment of the present invention.

FIG. 4 illustrates an embodiment of an automated cashier 400, which dispenses with the need for a human cashier. The automated cashier 400 may include an internal computer connected to the network 102 with the gaming terminals 104, a coin acceptor 422, a note acceptor 420, a coin dispenser/hopper 418, a SmartCard or magnetic card dispenser 404, a note dispenser 414, a ticket printer 410 for printing a ticket 412, a magnetic card reader 402, a SmartCard reader/writer 406, a barcode reader 408, display with touch-screen 426, a keypad 424, a video camera 428 and/or a UL 291 certified cash safe 416, for example. The UL 291 certified cash safe 416 prevents robbery of the cash stored inside the automated cashier 400. The automated cashier 400 may further include biometric ID readers, ID token readers to read other forms of advanced ID devices such as ID buttons, USB ID dongle, ID key-chains, etc., as well as secure communications means for communicating with personal wallets, hand held PCs or computer wrist-watch via infra red, magnetic field, capacitive charges or RF (Bluetooth, IEEE 802.11, etc.) for identification purposes.

Figure 5:
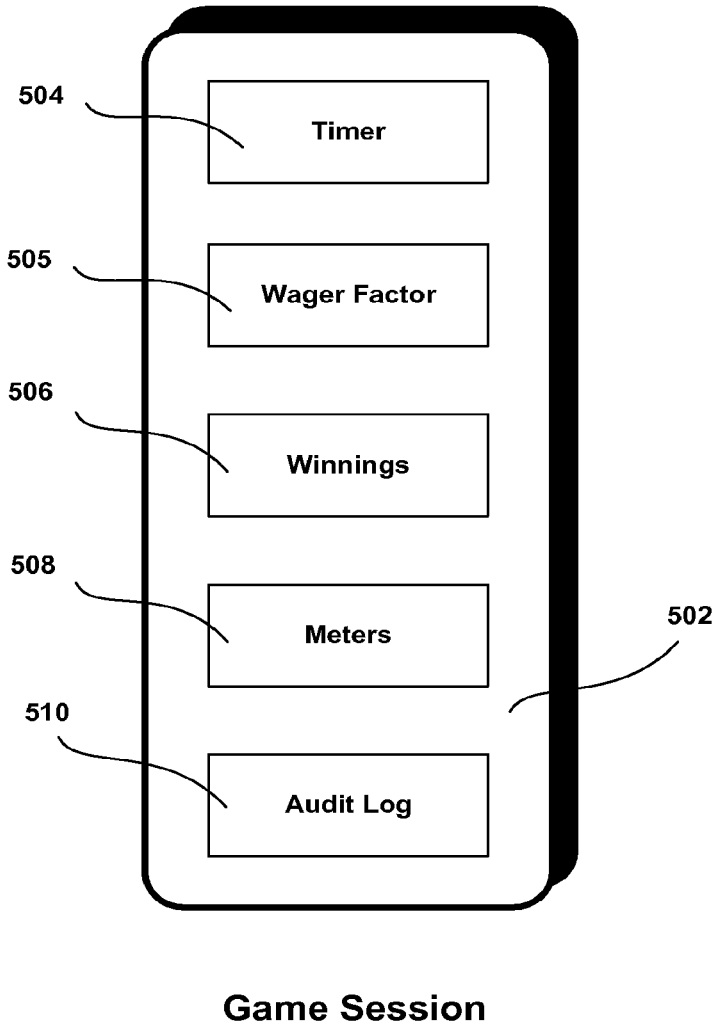
FIG. 5 is a diagram depicting the game session meters in accordance with an embodiment of the present invention.

In compliance with gaming jurisdictions, gaming terminals contain a set of highly secure persistent meters. FIG. 5 illustrates an embodiment of the meters 502 that control a gaming session comprising essentially the patron's game session timer 504, the wager factor 505, the patron's winnings 506, the meters 508 associated with a variety of events such as coins inserted and coins given out for a particular game, and an audit log 510 of events for later examination if required. The wager factor reflects the wager that is applied per unit of time; for example if the patron pays $100 for 2 hours of playtime, the wager factor is 100/2=$50 per hour or 100/(2*3600)=$0.0139 per second. Meters 508 and the audit log 510 are usually reserved for verification purposes by the game operator.

A preferred embodiment makes use of a down-counting timer that is exhausted (time-out) when reaching zero, but the same results may be achieved by making use of up-counting timers that are exhausted (time-out) upon reaching a predetermined value.

Figure 6:
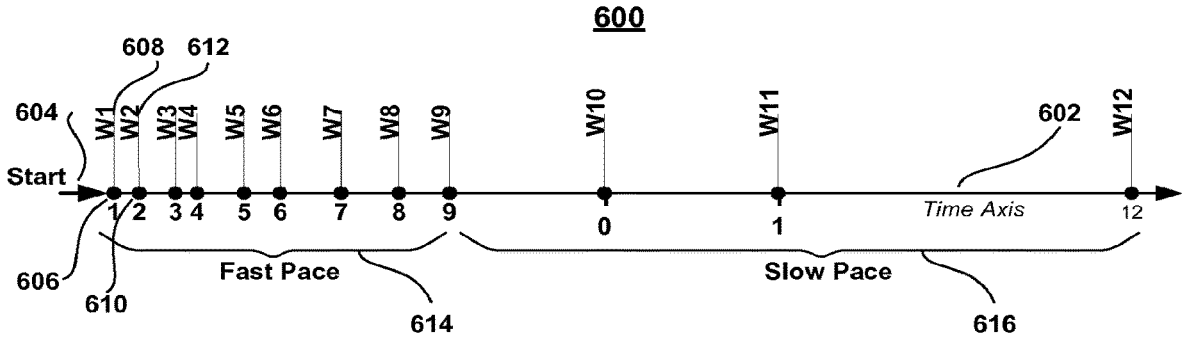
FIG. 6 is a diagram depicting the variable rate gaming during a game session in accordance with an embodiment of the present invention.

Upon initialization of a new game session, the timer is set to the playtime purchased by the patron and the winnings are set to zero. As soon as the patron starts playing, the timer is decremented with a predetermined clock tic, 1/100th of a second for example, and the game session ends when the timer reaches zero. As illustrated in FIG. 6, the patron may play at a variable pace. In the preferred invention embodiment, the wager applied at each game played is variable and is dependent on the pace at which the patron plays. The wager taken into account for calculating the winning outcome at each play is related to the time elapsed since the previous play, also called intermission hereafter. The faster the pace 614, the lower are the wagers considered for calculating the winnings outcome in case of a win. Conversely, the slower the pace 616, the higher are the wagers considered for calculating the winning outcome in case of a win.

As shown in FIG. 6, a game session 600 may start 604 when for example the patron triggers the play button for the first time 606. The wager W1 608 associated with the first play 606 may be a predetermined amount, $0.10 for example. Subsequent play triggers are plotted on the time axis 602. The wager W2 612 associated with the second play 610 that occurs 2.76 seconds after first the play 606 may be $0.23; wager W3 for third play that occurred 3.84 seconds after the second play 610 may be $0.32. Table 1 hereunder shows the wagers applied for each of the games played of FIG. 6, and until the session ends after 2 hours of playtime purchased for $100.

TABLE 1

| Play # | Intermission (sec) | Wager (in $) |
|---|---|---|
| 1 | — | 0.10 |
| 2 | 2.76 | 0.23 |
| 3 | 3.84 | 0.32 |
| 4 | 1.68 | 0.14 |
| 5 | 3.84 | 0.32 |
| 6 | 4.08 | 0.34 |
| 7 | 5.04 | 0.42 |
| 8 | 5.64 | 0.47 |
| 9 | 5.16 | 0.43 |
| 10 | 14.52 | 1.21 |
| 11 | 16.44 | 1.37 |
| 12 | 32.52 | 2.71 |
| . . . | . . . | . . . |
| Last | 5.04 | 0.42 |
| TOTAL | 2 Hours | 100.00 |

In a preferred embodiment, in case of a win, the interval of time between the last play and the previous play (the intermission) is taken into account as a multiplier when the winnings are credited. For example, for the same matching symbols, if the intermission is 5 seconds the winning amount credited is $100; if the intermission is 15 seconds the winning amount credited is $300.

Figure 7:
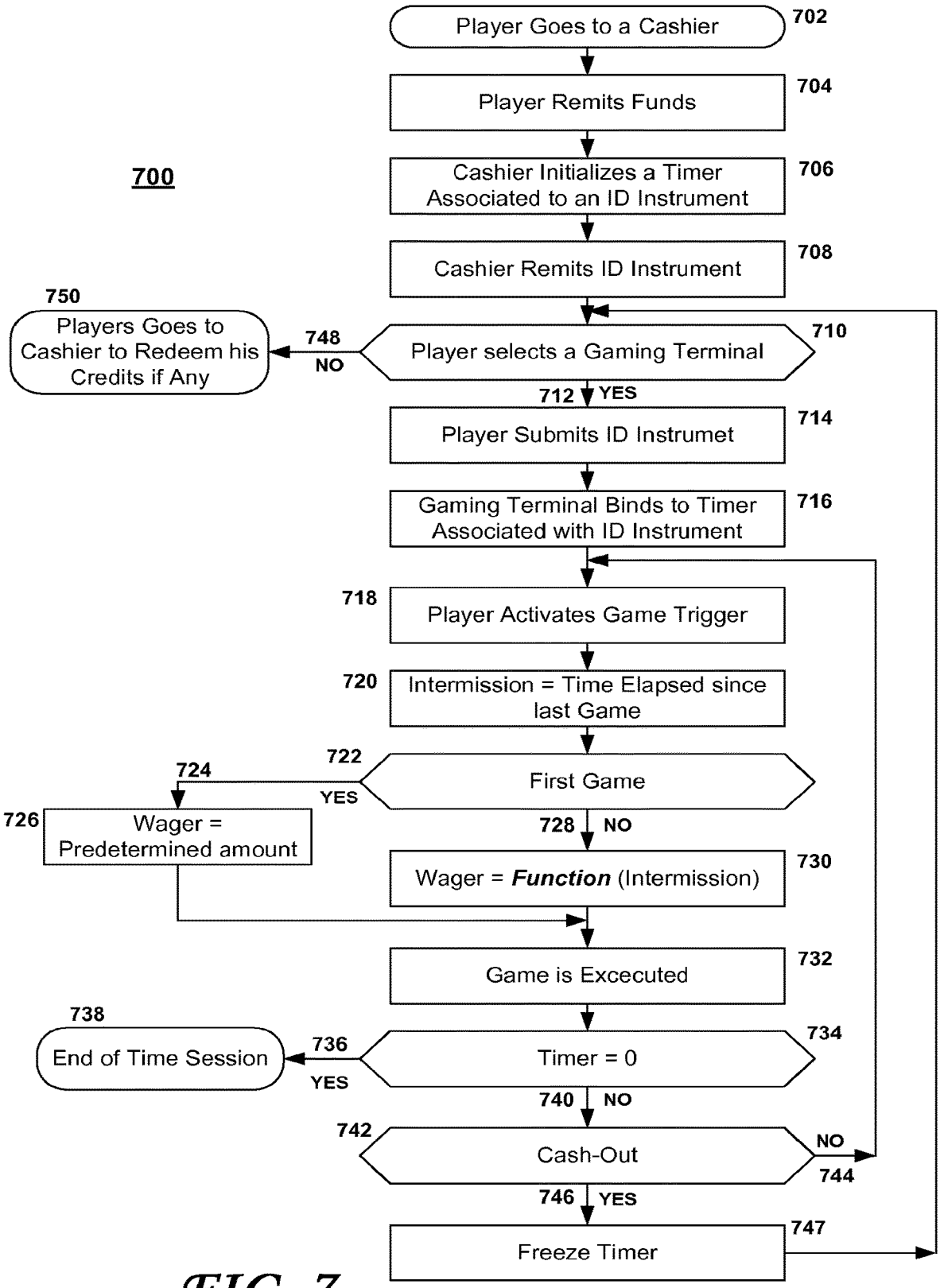
FIG. 7 is a flow diagram detailing a cashless time game session in accordance with an embodiment of the present invention.

FIG. 7 illustrates a cashless time game session in accordance with an embodiment of the present invention. The player goes to a cashier 702 and remits 704 for example $100 to play for 2 hours. Using a terminal 300, the cashier sets some parameters associated with an ID instrument 706 that he remits to the patron 708. The parameters are essentially: Instrument ID=X1Y2Z3, Timer=2 hours or 120*60=7200.00 seconds, amount=$100. The parameters are accessible by any gaming terminal on which the patron may play.

The patron then selects a gaming terminal at 710 and submits its ID instrument at 714. As shown at 716, the gaming terminal binds to a timer that is initialized with the parameters associated with the ID instrument. The timer may be located on the local gaming terminal or on a computer system accessible via the network. In this example, the timer is set to the value 720,000 assuming a tic timer of 1/100th of a second and the wager factor is set to 100/720000=$0.000139 per 1/100th of a second of intermission. Each time the patron triggers a new game 718, the intermission is captured, as shown at 720. In a preferred embodiment of this invention, the wager taken into account for the computation of the outcome in case of a winning at the first game 722. If this is the player's first game (YES branch 724), the wager is a predetermined amount 726, as shown at 726. If this is not the player's first game (NO branch 728), the wager taken into account for the computation of the outcome in case of a winning is a function of the intermission, as shown at 730. The game is executed at 732 and in case of a win, the prize money is credited to a winning account associated with the ID instrument. After a game completion, the game session is ended as shown at 738, if the timer 734 has timed-out as indicated at 736. If the timer has not timed-out (NO branch 740) and the patron wishes to continue to play (does not wish to cash out), the patron may continue to play, as indicated by the NO branch 744. If the patron, however, activates the cash-out signal 742, the method proceeds to 746, whereupon the timer is frozen at 747. The player may select another gaming machine 710 to play or, as shown at 748, may go to the cashier to redeem his winnings and unused time 750.

In a preferred embodiment, the wager variation together with the associated changing prize return while the time elapsed since last game increases, may be dynamically displayed to the patron.

In another preferred embodiment of the present invention, an automated cashier 400 is used by the patron instead of going to a cashier.

In yet another preferred embodiment of the present invention, the gaming terminals are equipped with coins and/or note acceptors and an amount of time to play is purchased directly on the gaming terminal by inserting the corresponding money amount. Any prize money won is paid-out immediately by the coin/note dispenser without interrupting the time game session. Alternatively, prize money is credited without interrupting the time game until timer times-out or the cash-out signal is activated.

In yet another preferred embodiment of the present invention, the patron may use prepaid card such as smart cards or magnetic card with a secret number to be revealed when scratching. The patron may also use prepaid vouchers comprising machine readable printed codes and optionally verification numbers to be keyed-in.

The time gaming method object of the present invention is suitable for supporting all forms of cashless instruments such as:

a player account;

an anonymous game session account;

a voucher verification account;

a smartcard reconciliation account.

A cashless player account is identified by a unique identifier key assigned to a patron that points to a set of records stored in computer memory containing the patron's personal details and the state of the cashless session. The records may be queried and updated by authorized software using the key, which may be derived from the ID instrument submitted. The state of the cashless session comprises essentially the balance of time-to-play and the total of winnings available to the patron and some auxiliary attributes reflecting the games played, the time stamping of various operations and a flag indicating if available credits have already been paid.

An anonymous game session account is identified by a unique identifier key assigned to a game session that points to a set of records stored in computer memory containing the state of the cashless session. The records may be queried and updated by authorized software using the key that may be derived from the ID instrument submitted. The state of the cashless session comprises essentially the balance of time-to-play and the total of winnings available to the anonymous older of the ID instrument and some auxiliary attributes reflecting the games played, the time stamping of various operations and a flag indicating if available credits have already been paid.

A voucher verification account is identified by a unique identifier key assigned to a voucher that points to a set of records stored in computer memory containing the state of the cashless session. The records may be queried and updated by authorized software using the key, which may be derived from the voucher submitted. The state of the cashless session comprises essentially the balance of time-to-play and the total of winnings available to the holder of the voucher and verification data, and some auxiliary attributes reflecting the games played, the time stamping of various operations and a flag indicating if available credits have already been paid. In the case of a cash-out at the gaming terminal or alternatively when funds are remitted to a human cashier or an automated cashier, a voucher comprising clear text and machine-readable code representing the monetary value of the credit available and some verification data is dispensed. The clear text may indicate the value of the credit of time-to-play available, or simply said for the holder, "the value of voucher." In the case of a cash-in at the gaming terminal or alternatively when requesting the redeem of the winnings to a human cashier or an automated cashier, a voucher comprising clear text and machine-readable code representing the monetary value of the winnings available and some verification data is read. The unique identifier key is derived from the verification data upon reading the clear text and/or the machine-readable code. The associated records are then queried in order to authenticate the value of the voucher by comparing the verification data contained in the records with the verification data read from the voucher. It should be apparent to those acquainted with secure transactional techniques that the unique identifier key, or alternatively the verification data, may be a hash or an encrypted signature of all or portion of the clear text and/or the machine-readable code.

A smartcard reconciliation account is identified by a unique identifier key assigned to a smartcard that points to a set of records stored in computer memory. The records therefore are a "slave" mirrored copy of same records containing the state of the cashless session that are maintained in the electronic circuits of the smartcard. The smartcard maintains the "master" copy of the records. The slaved mirrored records may be queried but not updated by authorized software using the key that may be derived from the smartcard submitted. The state of the cashless session comprises essentially the balance of time-to-play and total of winnings available to the holder of the smartcard and some auxiliary attributes reflecting the games played, the time stamping of various operations and a flag indicating if available credits have already been paid. The slaved mirrored records are used to reconcile accounting when the smartcard is used in order to detect possible forgery. Alternatively, the slaved mirrored records are used as a backup repository to pay the holder of the smartcard in case of the failure of the smartcard. When used for backup, the "slave" records may be updated by authorized software using the key that may be derived from the smartcard submitted (embossed code for example).

The ID instrument used to derive the unique identifier key may be submitted in a variety of ways such as typing a user ID and password, keying-in a code on a keypad, presenting a bar-coded voucher, an encoded card, a secure electronic ID device or recognizing biometric features.

The unique identifier keys are commonly called GUI or global unique identifier.

Figure 8:
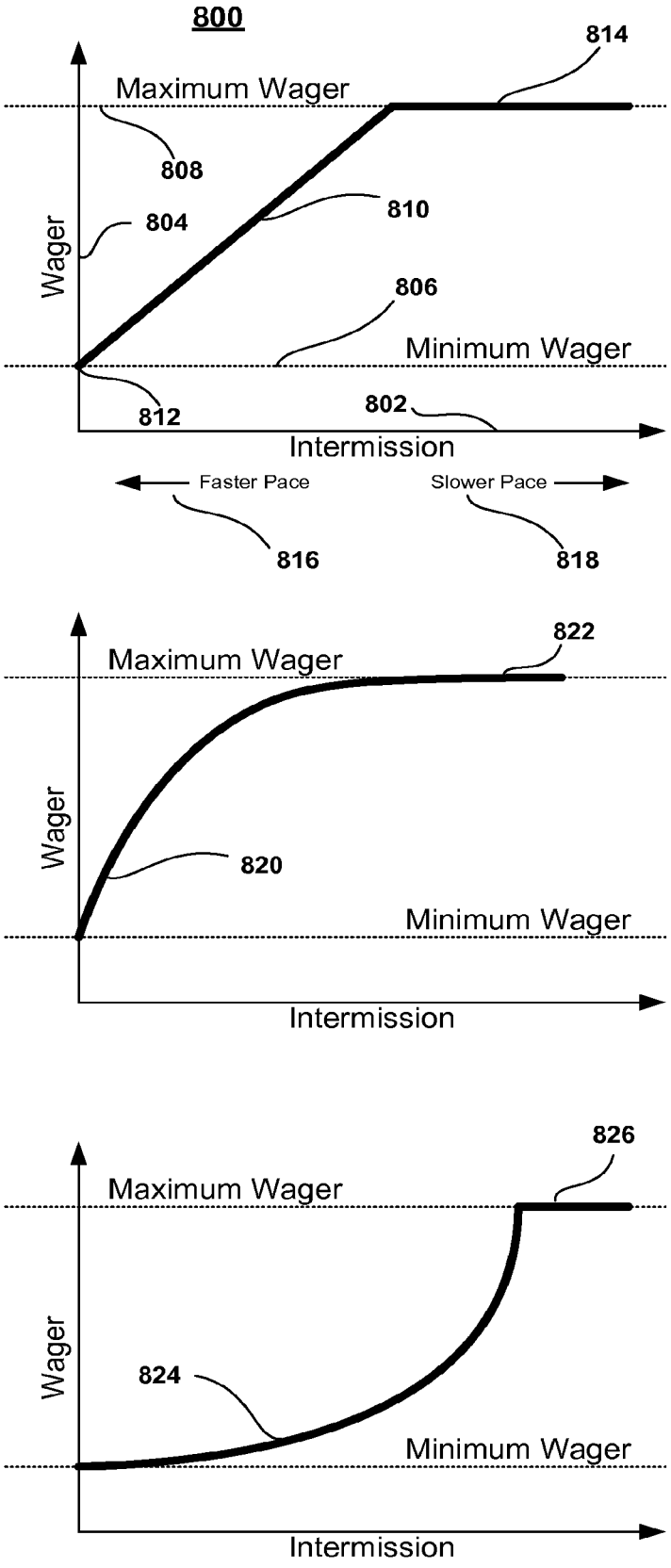
FIG. 8 is a diagram depicting various applicable time-function wager profiles in accordance with an embodiment of the present invention.

Various profiles 800 may be available for implementing the wager function, as shown in FIG. 8. For example, a linear function 810 may be chosen between a minimum wager 806 and a maximum wager 808, with a minimum wager amount 812 for the shortest intermission, and a maximum wager amount 814 when intermission exceeds a predetermined amount. Alternatively, an aggressive sensitivity to intermission acceleration 820 may be chosen which rapidly reaches the highest wager amounts 822 for the shortest intermissions. Alternatively yet, a soft sensitivity to intermission acceleration 824 may be chosen which reaches the highest wager amounts towards the largest intermissions.

In a preferred embodiment of the present invention, a prize matrix such as the exemplary matrix shown in table 2 may be simply constructed in which the prize money is proportional to the intermission.

TABLE 2

| | Prize Matrix Winnings US$ for X seconds Intermission | | | | | |
|---|---|---|---|---|---|---|
| Draw | 1 (reference) | 2 | 5 | 10 | 20 | 50 |
| 4 aces | 1,000 | 2,000 | 5,000 | 10,000 | 20,000 | 50,000 |
| 3 aces | 100 | 200 | 500 | 1,000 | 2,000 | 5,000 |
| 4 identical symbols | 200 | 400 | 1,000 | 2,000 | 4,000 | 10,000 |
| 3 identical symbols | 10 | 20 | 50 | 100 | 200 | 500 |
| . . . | . . . | . . . | | | . . . | . . . |

For other intermission values, the equation may be: Prize=Prize (Reference)*Intermission, wherein Intermission may be expressed in 1/100th of a second, for example.

In the exemplary table 2 above, the prize reference is set for 1 second. Consequently, in case of a win with 3 aces and an intermission of 2.73 seconds, the prize money is $100*2.73=273.00.

In a preferred embodiment of the present invention, a facility may be provided to enable the player to play games in a synchronized fashion in which games are automatically triggered by some form of psychedelic or ambiance input such as music tempo, microphone input tempo and video tempo. The games are automatically triggered following a manual arming activated by the player.

Figure 9:
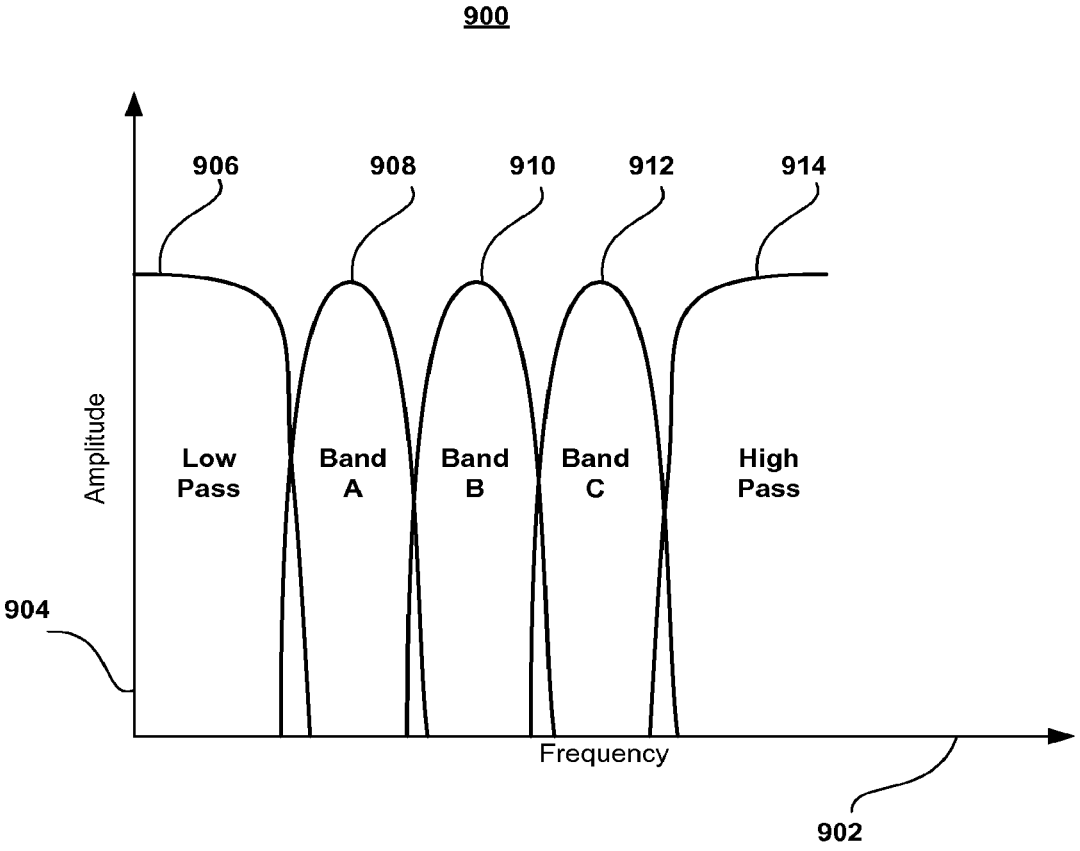
FIG. 9 is a diagram depicting audio frequency filters in accordance with an embodiment of the present invention.

FIG. 9 illustrates a typical set of sound frequency filters plotted on a frequency axis 902 versus an amplitude axis 904 for driving the psychedelic lights commonly found in disco-dancing places whereby multicolored spotlights are modulated by the music played. Spotlights of a given color are associated with a given filter band to achieve a desired illumination rhythm. For example, purple colored spotlights may be associated with the low pass filter 906, green colored spotlights may be associated with the high pass filter 914, yellow colored spotlights may be associated with the A pass-band filter 908, blue colored spotlights may be associated with the B pass-band filter 910 and red colored spotlights may be associated with the C pass-band filter 912.

Frequency filters may be implemented using analog electronic circuits and digital electronic circuits. Alternatively, the signal to filter may be digitized then mathematic functions may be applied in software in order to obtain the desired filtering to modulate or trigger a given device such as a spotlight, an alarm, and an event.

The output of a selected filter applied to music, speech, surrounding sound, surrounding light, or video images may be used as an external triggering event to start a game. An adjustable level threshold control button may be used for triggering for example. A manual arming by the player may be advantageously provided prior to the triggering by an external event.

Figure 10:
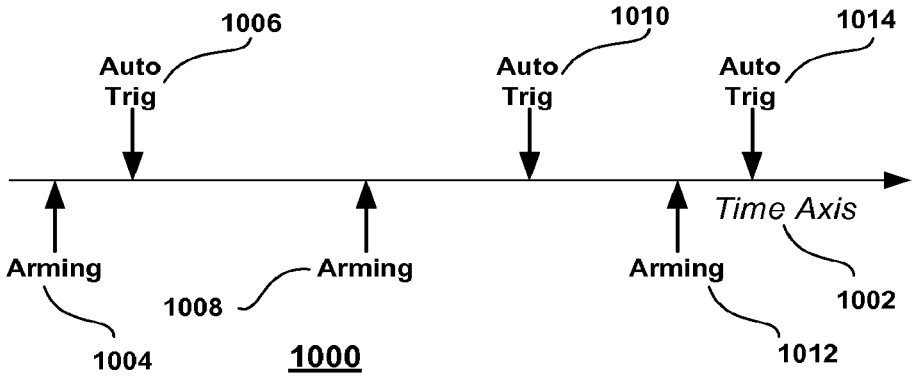
FIG. 10 is a diagram that depicts manual arming by the patron followed by one auto trigger in accordance with an embodiment of the present invention.

FIG. 10 illustrates on a time axis 1002 the manual arming 1004 activated by the player. An auto triggering 1006 signal driven by the filtered external event may occur at any time subsequent to arming. The triggering signal starts the game. For another game to be played, the player may arm again 1008, and then an auto trigger occurs moments later. This scenario may be repeated continuously whereby an auto trigger occurs moments later after a manual arming by the player and whereby the triggering is driven by an external event, until the credit of time is exhausted or the cash-out event is activated. In scenario 1000, only one trigger can occur after each arming. The intermission to compute the wager amount is the time elapsed between triggering events.

Figure 11:
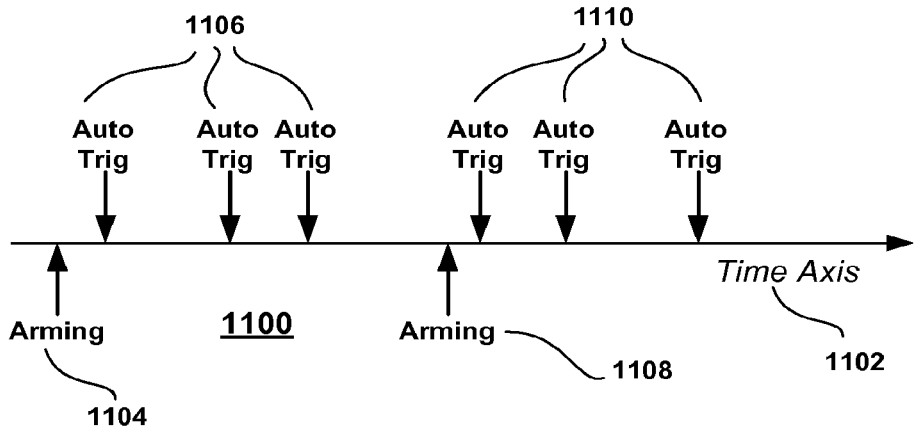
FIG. 11 is a diagram that depicts manual arming by the patron followed by three auto triggers in accordance with an embodiment of the present invention.

FIG. 11 illustrates another scenario wherein three (3) automatic triggers 1106, 1110 may occur after each manual arming 1104 and 1108 respectively initiated by the player. The choice for the number of triggers occurring automatically after an arming as well as the external triggering source may be selectable by the player. The intermission to compute the wager amount is the time elapsed between triggering events; the instant when the arming occurs is ignored.

Figure 12:
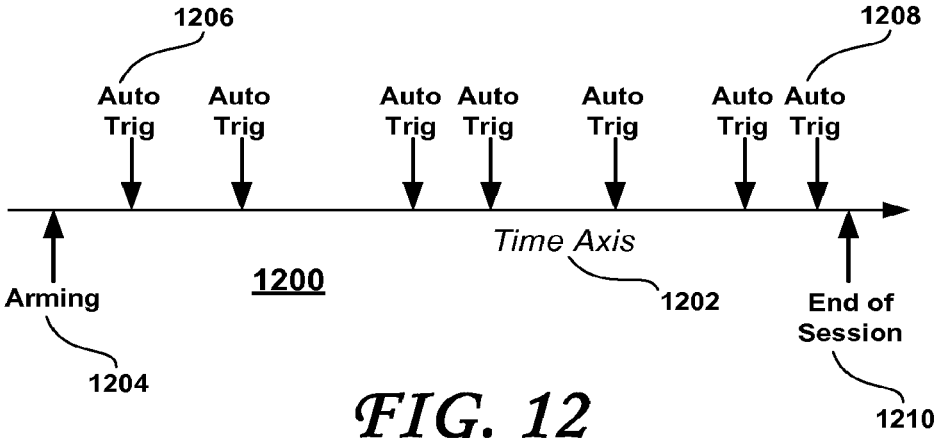
FIG. 12 is a diagram that depicts manual arming by the patron followed by continuous auto triggers in accordance with an embodiment of the present invention.

FIG. 12 illustrates a scenario wherein continuous automatic triggers 1206 to 1208 may occur after an initial manual arming 1204 performed by the player. The triggers occur automatically and continuously driven by the external triggering source selected by the player. The parameters of the triggering source may be varied by the player in order to obtain a desired triggering tempo. The intermission to compute the wager amount is the time elapsed between triggering events.

Further embodiments of the present invention include games of skill and or mixed games of chance and skill. Although not currently allowed in all gaming jurisdictions, games of skill (the phrase "games of skill" hereinafter to include games in which the player's skill is a factor in the outcome, irrespective of whether elements of chance are also a factor in the outcome) may be adapted to the time gaming paradigm disclosed herein. Indeed, according to an embodiment of the present invention, a player may pay a certain sum of money to play a gaming machine for a predetermined period of time. That is, a player may activate a game session on a gaming machine with a credit of playing time, the game session enabling the player to play the game(s) offered on the gaming machine for an amount of time determined by the credit of playing time. The game of skill may involve a narrative, a quest, or a predetermined goal (such as winning a race or vanquishing an enemy, for example). Examples of such games are disclosed, for example, in co-pending and commonly assigned U.S. provisional patent application Ser. No. 60/738,812 entitled "Multi-Act Style Electronic Game," which application is hereby incorporated by reference in its entirety. Skill, within the context of the present invention, encompasses feats of manual dexterity, as well as problem solving and other manifestations of intellectual prowess. The term skill, within the context of the present invention may also be extended to encompass how well a player cooperates with others in solving a common task, in a multi-player game. Other embodiments of the present invention are compatible with and may be adapted to function with commercially available gaming console-type games, such as the games available for the game consoles from Microsoft, Sony and Nintendo or Electronic Arts, for example. Specific examples include, for example, first person games based upon the popular Super Mario character, the Need For Speed series of games, Packman and others. Other embodiments of the present invention may be natively-developed games that find no counterpart in the games available for game consoles.

According to embodiments of the present invention, such games may be modified to support wagering within the context of, for example, a gaming session of limited duration, as determined by the player's credit of playing time. For example, in the case of Super Mario, the title character may pursue his eternal quest and evade capture, avoid being blown up, being eaten and suffering like perils and indignities. Instead of collecting coins, points, health or lives, as is the usual case with such console games, each or selected challenges faced by the character may define a new wagering opportunity. The amount of the wager may be a fixed amount determined by the game, may be a fixed amount chosen by the player and/or the amount of the wager may be dependent upon the time period that has elapsed since the player's last wager. That is, the wager may be a flat amount (e.g., $5) as selected by the gaming machine or as chosen by the player, or may be, for example, a base amount multiplied by the above-described wager factor (which reflects the wager that is applied per unit of time and which may grow or otherwise change as the time between successive wagers increases) or otherwise affected by the intermission. In this manner, the player's skill is instrumental in the outcome of the game, in that a more skillful player will tend to be more successful in navigating through the game's different levels and avoiding pitfalls that may plague comparatively less skilled players—as contrasted with, for example, betting games such as one arm bandit fruit games, in which skill plays no factor whatsoever in the determination of the outcome. However, for each or selected ones of the game features (bombs, assorted perils) for which console gamers would conventionally accumulate (or subtract) points, games according to embodiments of the present invention enable a wager to be placed. The outcome of the wager (as opposed to the outcome of the game, e.g., winning the race, rescuing a Princess from a castle, reaching a higher game level) is random. That is, the outcome of the wager is determined by one or more random number generators, as is known in the gaming industry. In this manner, games and game machines according to embodiments of the present invention enable casinos and other gaming establishments to leverage the enormous goodwill and accumulated store of skill represented in players of consumer game consoles into exciting betting games (with which the players may already be familiar and proficient in the non-betting variant thereof) and additional revenue streams.

Figure 13:
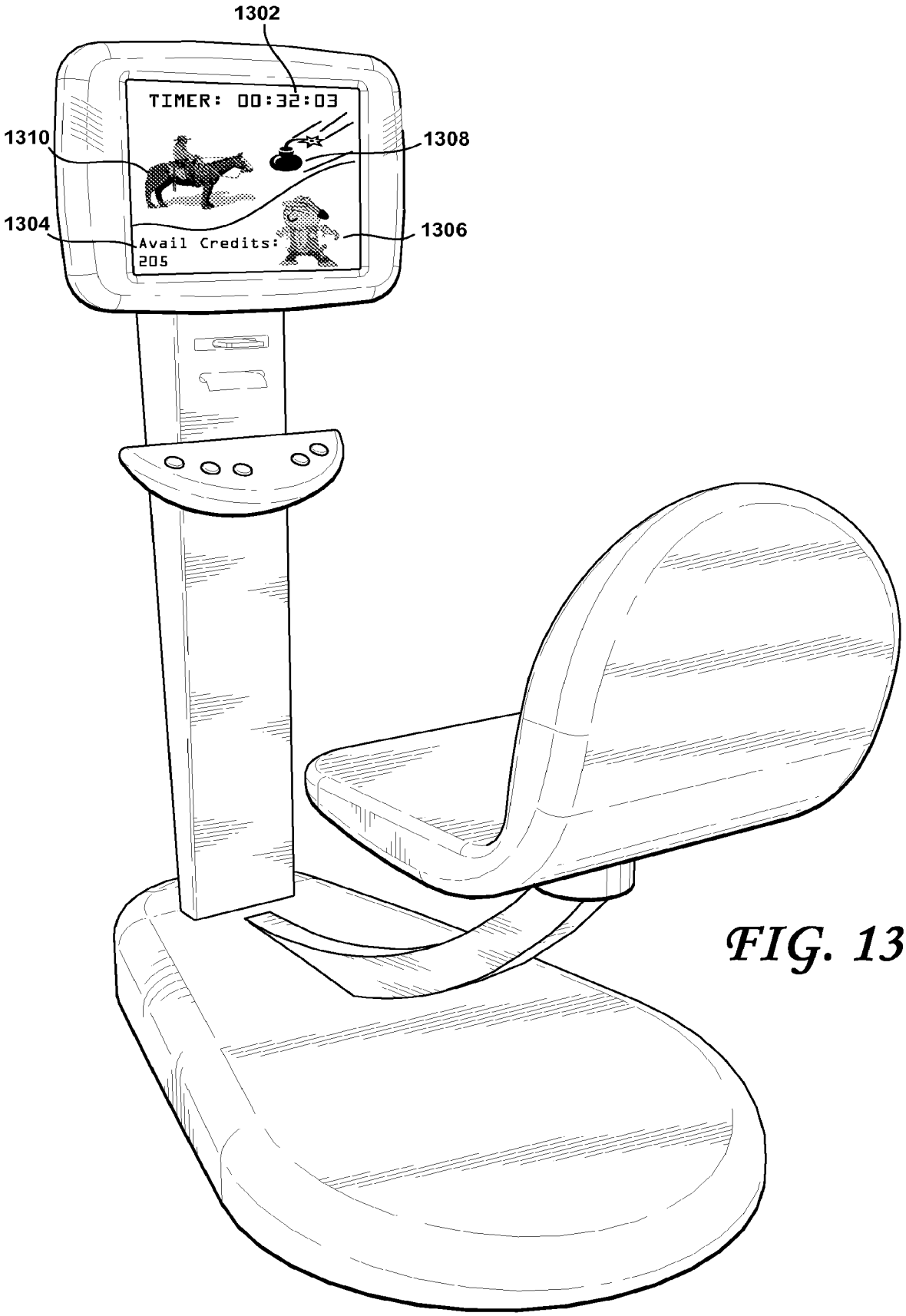
FIG. 13 shows an example of a game of skill that offers wagering opportunities, according to an embodiment of the present invention.
Figure 14:
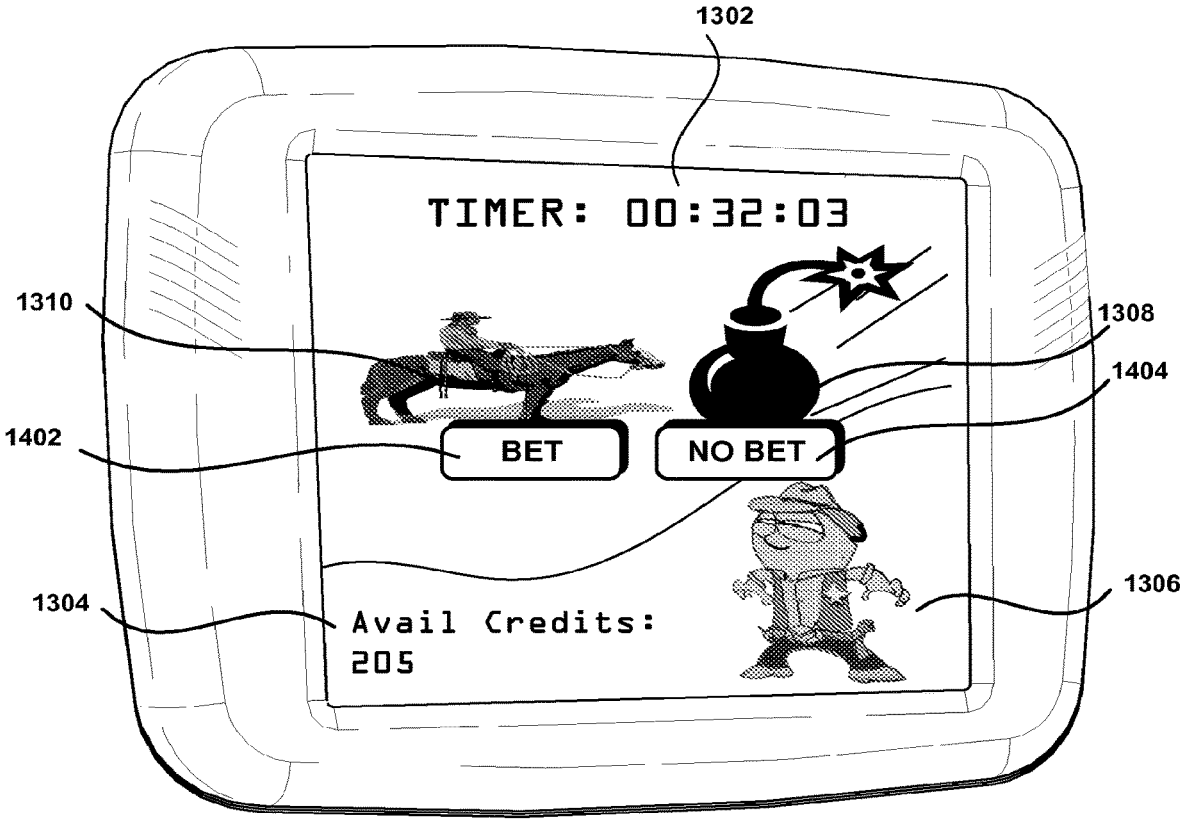
FIG. 14 shows the game of skill of FIG. 13 and the "Bet" or "No Bet" buttons that require the player to positively confirm his or her intention to bet on the offered wagering opportunity, according to another embodiment of the present invention.

For example, as shown in FIGS. 13 and 14, an embodiment of a game according to the present invention is a console-type game in which a character 1306 controlled by the gaming machine player must navigate through a varied terrain while encountering perils and challenges which he must overcome. One such peril is shown in FIG. 13, in which a bomb 1308 is rolling down a hill, potentially endangering the character 1306 and/or the cowboy 1310. At this point in this exemplary game, the gaming machine player may have a choice of one or more strategies or tools to defuse the bomb and/or cause it to explode harmlessly. The player may choose to employ one of these strategies and/or tools to overcome the threat posed by the rolling bomb 1308. The outcome of employing such strategies and/or tools may, at least in part, depend upon the skill of the player wielding them. At this point in the game, whereas a conventional console-type game would award if player was successful) or take away points, health or lives if the player was not successful), a gaming machine and game according to embodiments of the present invention may either automatically wager a predetermined amount (chosen by the player or the gaming machine, depending upon the implementation and what is allowed in the relevant gaming jurisdiction) on the outcome of the player's attempt to defuse the bomb 1308. According to embodiments of the present invention, the gaming machine (or a server coupled to the gaming machine) may then determine the outcome of the wager randomly, based upon the output of one or more random number generators. The gaming machine would then award a specific amount of money or credits, depending upon predetermined odds for the peril the player attempted to overcome. According to embodiments of the present invention, the amount wagered may be dependent upon the elapsed time since the last time that the player placed a wager during his or her gaming session, in the manner described relative to, for example, FIGS. 6-12. As shown in FIG. 13, the player's current credits or balance may be shown (periodically or all the time), as shown at reference numeral 1304. The remaining time of the player's credit of playing time may also be shown, such as at reference numeral 1302. In the illustrative example of FIG. 13, the player has about thirty two minutes remaining of the gaming session. Unless extended by some mechanism in the game, the player's game session will end at the expiry of his or her remaining credit of prepaid playing time.

The perils and challenges that the player must overcome may be collectively referred to as "winning features." The player may be exposed to countless such winning features during his or her credit of playing time. The game may be a new game or a new type of game with which the player may not initially be familiar. With richly rendered graphics and sound, engaging interactivity and compelling plot, however, the player may rapidly find him or herself invested in the outcome of the game. Other embodiments of the present invention, however, contemplate the modification of existing console and/or arcade-type games such that a plurality of wagering opportunities arises during the course of game play. Such games may already be familiar to many players. When coupled with the wagering features described herein, such games may become even more popular. Indeed, gaming machines may be configured to play console or arcade-type games aimed at a specific demographic, such as, for example, age. Indeed, the functionality of such old standbys as Pac Man, Missile Command, Mortal Kombat or the series of games based upon the Star Wars® universe may be increased by adding wagering opportunities to the game play thereof, as described above.

Enabling an Auto-Bet feature in which the gaming machine automatically places a wager on the winning feature (the wager being dependent upon, for example, the elapsed time since the last time a wager was placed—that is, dependent upon the intermission) may not be allowed in the relevant gaming jurisdiction. In that case, another embodiment of the present invention may include features that may render the game allowable by local gaming authorities. Indeed, as shown in FIG. 14, each time a player encounters a winning feature, buttons 1402, 1404 (or a similar functionality) may appear or may be made active, inviting the player to positively choose whether to Bet 1402 or Not Bet 1404 on the winning feature. Other functionality may be included to enable the player to choose the amount of the bet, in addition to choosing whether to place a bet in the first place. According to one embodiment of the present invention, should the player select the Bet button 1402, the gaming machine may automatically determine the amount to wager depending upon the elapsed time since the last wager placed or may request that the player select a wager. Thereafter, the outcome of the wager is wholly random, with the credits or money awarded if the player wins) or taken away if the player looses) being dependent upon predetermined odds for that winning feature and generated random number(s). Accordingly, embodiments of the present invention provide for methods and systems for players to purchase a time credit, play a vibrant console type or arcade-type skill game and place countless numbers of bets until the time credit has elapsed. Other embodiments of the present invention enable a two-player console type skill game that allows two players to enter a fierce challenge and place countless numbers of bets until the time credit has elapsed. Wherever gaming regulation allows time-gaming Auto-Bet, then the bet outcome result (instead of fixed points) may be briefly shown and accumulated each time a winning or losing feature is hit along the play path; otherwise a "Bet" or "No Bet" prompt confirms that a betting opportunity has been offered and requests that the player confirm his or her intention to place the bet.

It should be noted that, in order to use and/or modify existing console-type or arcade-type games in conjunction with embodiments of the present invention, the proper authorizations and licenses from the owners of the games must be obtained.

Assume now, for example, that the game is a racing game of chance in which the player has paid $100 for two hours of game play. Suitable racing games are disclosed, for example, in commonly assigned application Ser. No. 10/389,463, filed Mar. 13, 2003, now U.S. Pat. No. 7,291,070, which is hereby incorporated herein by reference in its entirety. The player's wagers may be, as detailed above, dependent upon the time elapsed since the last wager. For example, the player may be invited to wager as to which vehicle(s) will first pass the finish line, may be invited to wager on which vehicles will post the fastest lap times or, for example, may be invited to place a wager on the color (or sponsorship, for example) of the vehicles passing the finish line. The actual event(s) wagered on may be selected by a random number generator (RNG), as is well known. Therefore, the actual outcome of the game is determined randomly, even though the player may be given the impression that his or her skill affects game play or his or her reward.

Other embodiments of the present invention allow for even greater wagering choices. For example, the game play may involve a narrative, or may include individual events that are loosely coupled to one another to form a narrative or a developing story. Even a car racing game may be structured as a narrative, with lap-by-lap commentary, stats and pit stops. According to embodiments of the present invention, the player may be provided with additional wagering opportunities, even during the time-based gaming described above. Continuing with the car racing game example being developed herewith, the timed game may be configured to stop the main gaming action (in effect, "freezing" the action) for the purpose of offering an additional betting opportunity to the player. Such a separate betting opportunity may, according to an embodiment of the present invention, be contextually driven and may be unrelated to the betting opportunities of the car racing game. Indeed, the additional betting opportunity may be derived from what is currently happening in the game (i.e., the current context of the game). For example, in a racing game in which a wide angle shot of the raceway is displayed on the gaming machine's display(s), the player may be given the opportunity to bet whether a sponsor's blimp will float across the sky over the raceway within a predetermined period of time. Alternatively, the player may be given the opportunity to place a wager on which of a predetermined list of products or services will next be advertised on the sides of the blimp, thereby affording additional revenue streams from product placement spots within a regulated game of chance. In any event, the main game play (in this exemplary case, the car race) may be momentarily interrupted, and the player invited to place a wager. According to other embodiments, game play need not be stopped when an additional wagering opportunity is presented to the player. Such an invitation may take the form of, for example, a pop-up window over the display. Such a pop-up window may request that the player make a choice whether to place a wager or to decline to do so. This may take the form of, for example, player-actuable "Bet" and "No Bet" buttons appearing on the screen. This betting opportunity may also appear for a limited period of time, and a down-counting (for example) timer may also be displayed. Failure to choose whether to place the wager or to affirmatively decline to do so may result in the offer to place the wager being rescinded at, for example, the expiration of the timer. In any event, an affirmative action by the player (e.g., the player pressing the "Bet" button before expiry of the down-counting timer) may be required for a wager on the offered additional betting opportunity to be placed.

Assuming the additional wager has been placed, game play may be resumed from the point at which it was previously interrupted. That is, the car race may resume as of the point at which it was interrupted to bring this additional wagering opportunity to the player. Moments later, during the on-going race, the player may view the randomly generated outcome of his or her additional wager. Continuing with the example developed herein, a blimp may cross the sky above the raceway (which would be a win for the player if the player had wagered on the blimp appearing in the sky) or, for example, a formation of supersonic fighter aircraft may streak across the sky above the raceway instead, signaling that the player has lost this particular additional betting opportunity (because the player bet that a blimp would float across the sky, and not fighter aircraft). Alternatively, the blimp may appear and display an advertisement of the product or service. If the displayed advertisement features the wagered product or service, the player wins this particular additional betting opportunity.

Figure 16:
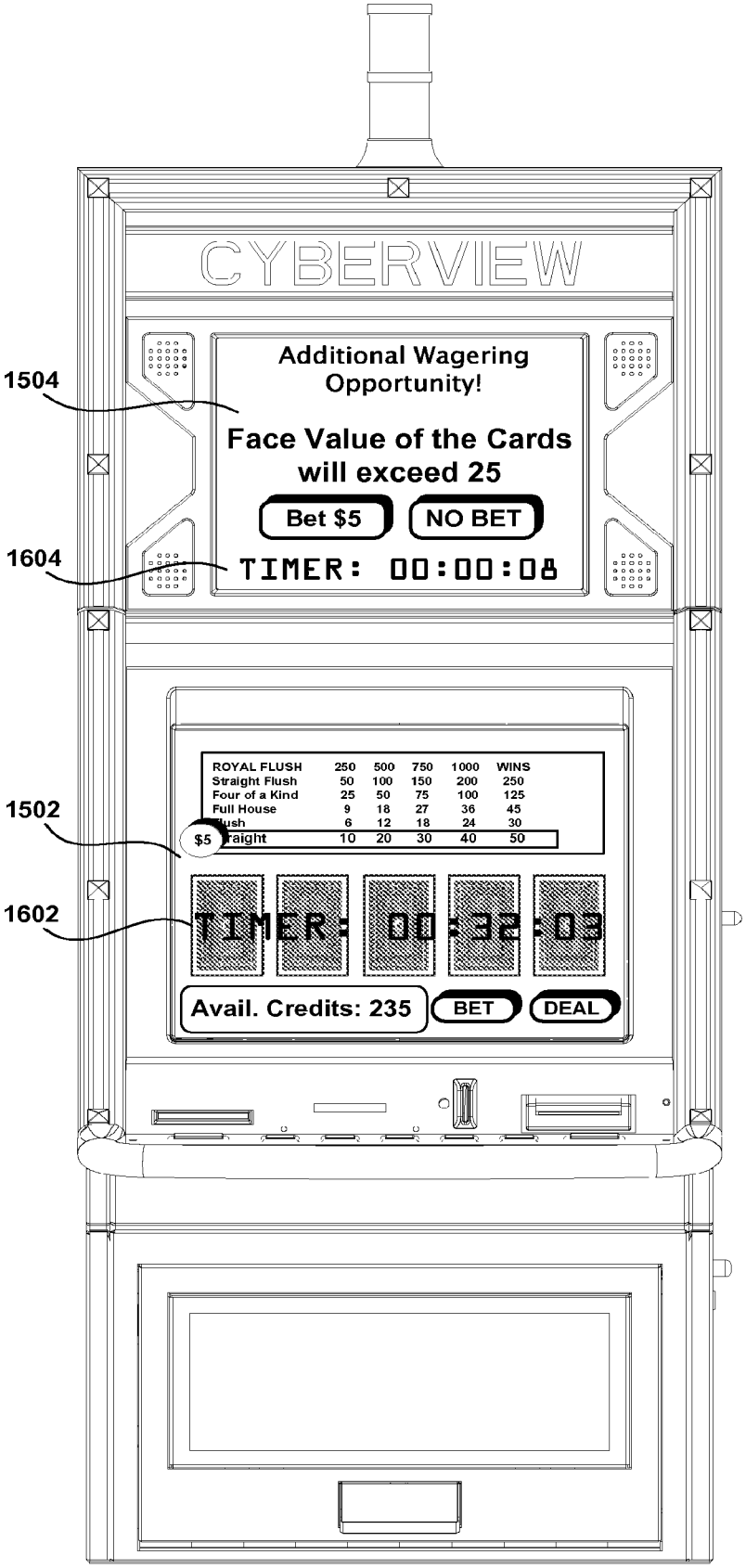
FIG. 16 shows an exemplary contextually-driven additional wagering opportunity, to illustrate further aspects of embodiments of the present invention.

As shown in FIG. 16, according to an embodiment of the present invention, the main timer 1602 (the timer counting down the remaining time of the current cashless time game session) may be stopped when the additional wagering opportunity is displayed or the main timer may continue counting down. If the main timer 1402 is stopped, the time the user spends on the additional wagering opportunity does not count in the computation of the wager factor described above. If the main timer 1402 is not stopped and continues counting down as the player considers whether to avail him or herself of the additional wagering opportunity, the wager factor may continue to increase as set forth above, thereby affecting the amount of any future win in the primary game.

Figure 15:
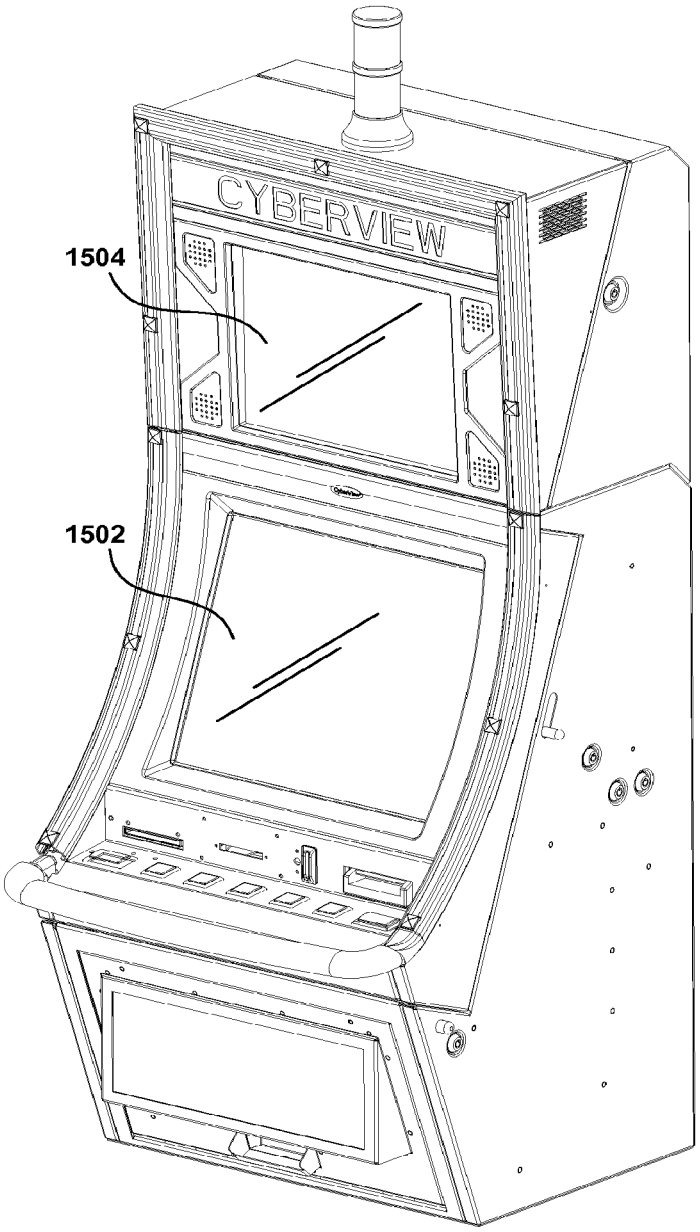
FIG. 15 shows a two-display gaming machine on which embodiments of the present invention may be practiced.

As shown in FIGS. 15 and 16, the primary game on which the cashless time game session is played may be displayed on a first display 1502 and the additional wagering opportunity may be displayed on a second display 1504. Alternatively, the additional wagering opportunity may simply overlay the primary game, displayed within the same display. In the example of FIGS. 15 and 16, the gaming machine includes two displays. Further details of the gaming machine of FIGS. 15 and 16 may be seen in co-pending and commonly assigned U.S. design patent application Ser. No. 29/233,830, which application is also hereby incorporated by reference in its entirety. As shown in FIG. 16, the primary game of the current cashless time game session may be, for example, a video poker game. During the cashless time game session, the gaming machine may provide the player with additional wagering opportunities that may be based upon the current context or state of the on-going game. In the example shown in FIG. 16, the additional wagering opportunity is based upon the current face-down state of the cards. In this example, therefore, the current face-down state of the cards is the context that triggers the offering of the additional betting opportunity shown in the display 1504. In this example, the additional wagering opportunity of FIG. 16 allows the player to bet on whether the face value of the cards yet to be turned over will exceed 25. The player, to avail himself/herself of this additional betting opportunity, must affirmatively press the "Bet" button. If the player does nothing or presses the "No Bet" button, no wager will be placed on whether the face value of the cards will exceed 25. Note that the timer of the primary game, shown at 1602, may be stopped while the additional betting opportunity is active or may continue unimpeded, with consequent effect upon the wager factor.

As discussed above and as shown relative to FIG. 16, the additional wagering opportunity may be contextually driven, with the context being derived from the primary game; that is, from the current cashless time game session. Alternatively, the context driving the timing of when the additional wagering opportunity appears, as well as the nature of the additional wagering opportunity may originate from outside of the primary game and/or even from outside of the gaming machine itself, subject to applicable gaming regulations. For example, the additional wagering opportunity may be linked to a progressive jackpot on neighboring gaming machines, thereby affording to player to participate in such games also, during his or her game play of the primary game during the current cashless time game session. Therefore, although the additional betting opportunity may be contextually driven, the context that drives it need not be that of the primary game. The additional wagering opportunity may specify the amount the player is allowed to bet (in the exemplary case shown in FIG. 16, that amount is $5) or may allow the player the flexibility of choosing the amount of the additional wager. The wager may be a flat amount (e.g., $5), or may be multiplied by the above-described wager factor (which reflects the wager that is applied per unit of time and which may grow as the time between successive wagers increases) or otherwise affected by the intermission. In turn, the wager factor or intermission may be that of the primary game or may be a wager factor or intermission computed solely from and for the additional wagering opportunity. Therefore, the additional wagering opportunities may themselves form another cashless time game session.

The additional wagering opportunity shown in the second display 1504 may persist for a predetermined period of time. In that case, an additional wagering opportunity timer 1604 may countdown the remaining time during which the player may make up his or her mind whether to participate or decline to participate in this additional betting opportunity. Alternatively still the additional betting opportunity may persist for as long as the event or condition in the primary game warrants it. That is, in the case of video poker, the additional wagering opportunity to bet on whether the face value of the cards will exceed 25 may be withdrawn only after one or more cards are turned over. Alternatively, the additional betting opportunity may be updated according to the face value of the card that was turned face up. Likewise, in the case of a car race, the additional wagering opportunity that the next car to pass the player's car will be blue would no longer be available when the color of the next passing car is revealed to the player. Therefore, the timing of the appearance, the nature of and the disappearance of the additional wagering opportunity may be contextually driven by what is currently happening in the primary game, in the gaming machine or dependent upon events or conditions prevailing external to the player's gaming machine, to the extent allowed under prevailing gaming regulations.

The context that drives the offering of one or more additional wagering opportunities need not be a single event that occurs within the primary game, such as the video poker game shown in FIG. 16. In fact, the player's performance may be analyzed over time and an additional wagering opportunity may be crafted in a dynamic fashion, based upon the results of the analysis of the player's behavior and/or performance. Such data may be combined with player data keyed to the player's loyalty card to offer even richer and personalized additional wagering opportunities that are unique to the player.

Figure 17:
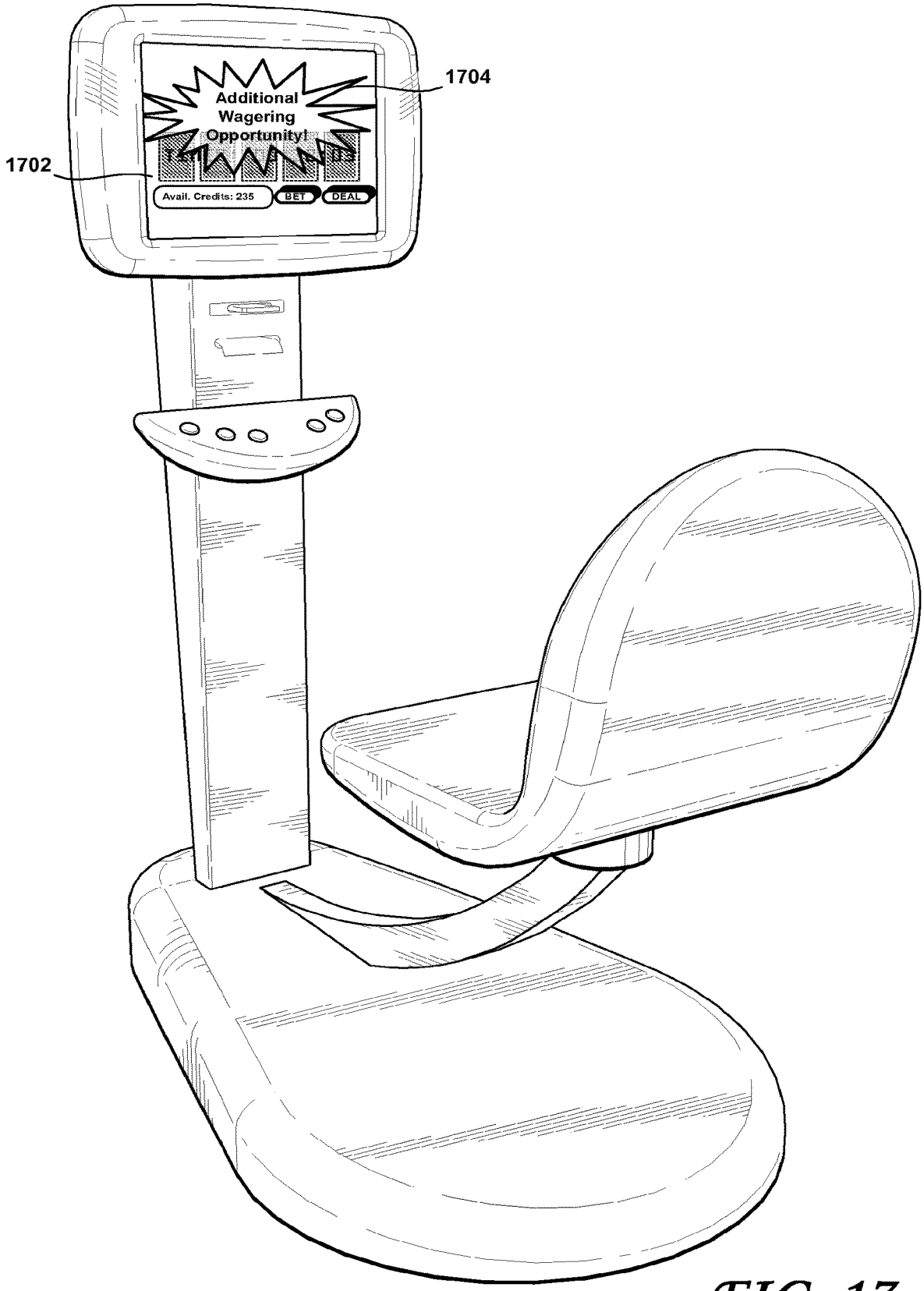
FIG. 17 shows an example of a single-seat single display gaming machine on which embodiments of the present invention may be practiced.

As shown in FIG. 17, the additional wagering opportunity may be displayed on the same display 1502 as is the primary game. For example, the additional wagering opportunity may be displayed on the (e.g., single) display 1702 of the gaming machine as a pop-up window, as shown at 1704. The appearance of the additional wagering opportunity may be preceded, accompanied and/or followed by any number of player-perceptible effects, such as graphic effects, sound, vibrations, etc., all designed to heighten the player's interest and excitement. As shown, the pop-up window announcing and/or containing the additional wagering opportunity may become more transparent over time, until such time as it disappears from the player's view altogether, at which point the player may not avail him or herself of the additional betting opportunity.

In narrative based games of chance, richly rendered virtual environments are presented to the player. Such rich environments offer a wide variety of additional wagering opportunities, as most any happening or artifact in the environment may be used as the basis of an additional wagering opportunity. For example, in a medieval dragon-slaying game of chance, the player might be invited to place a wager on whether the dragon's fire breath will incinerate a bunny rabbit shown frolicking nearby—decidedly not a major thematic element in the valiant Prince's dragon slaying quest. The frequency of additional wagering opportunities offered to the player may be selected such they do not unduly fragment the primary game play. According to further embodiments, the frequency with which such additional wagering opportunities present themselves to the player may be adaptive. That is, if the player consistently chooses not to avail him or herself of the offered additional wagering opportunities, such opportunities may present themselves at increasingly infrequent intervals, and may eventually not be presented to the player any more, if it is determined that the player is not interested in pursuing such additional wagering opportunities, preferring to concentrate on the primary game play, as evidenced by the player's past behavior.

Figure 18:
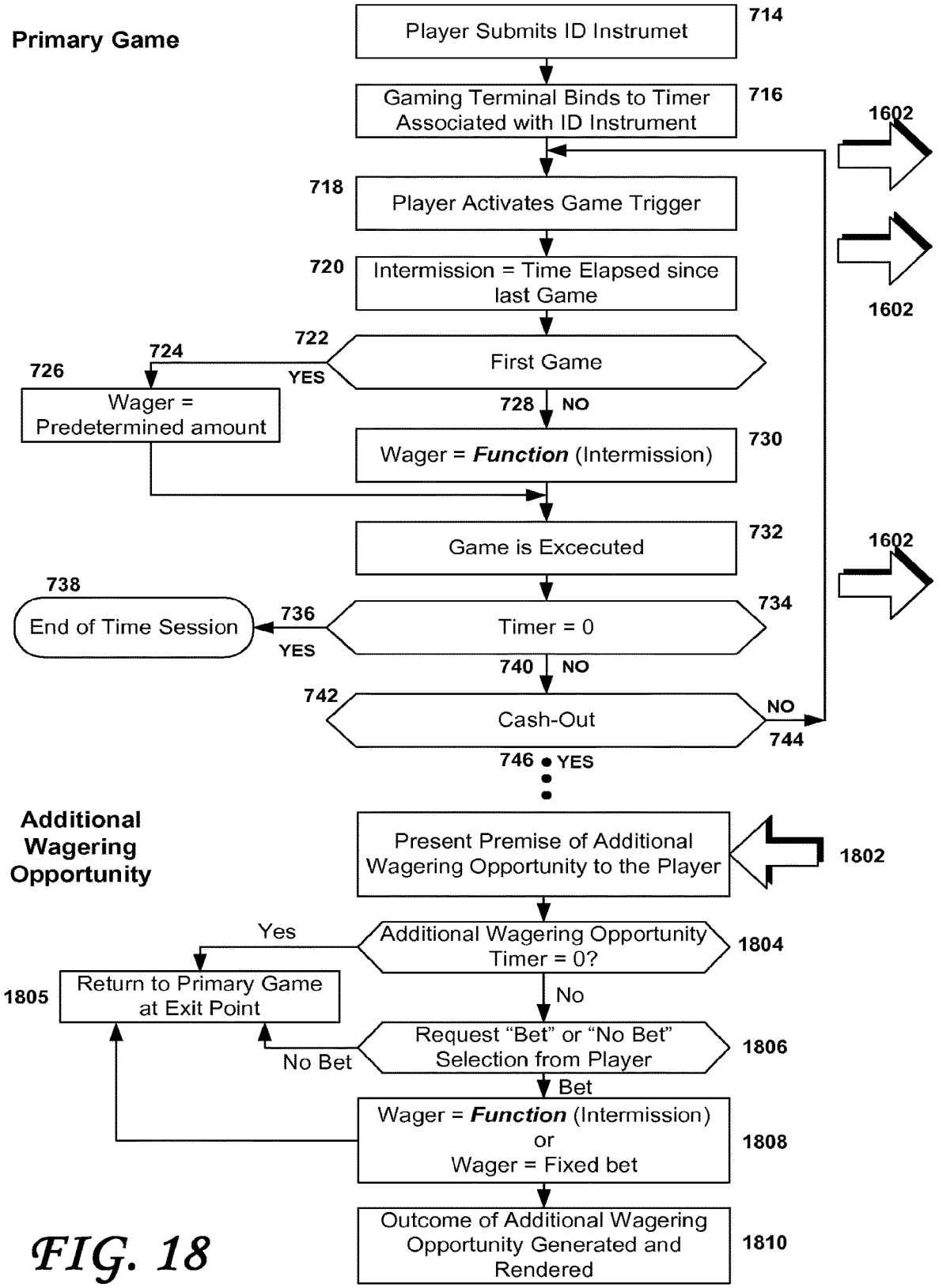
FIG. 18 is a flowchart illustrating further aspects of embodiments of the present invention.

FIG. 18 is a flowchart illustrating additional features of embodiments of the present invention. As shown therein, steps 714 to 744 are duplicated from the flowchart of FIG. 7 and the description thereof is omitted. As shown at 1802, at various points during game play, additional wagering opportunities may be offered to the player. For example, such additional wagering opportunities may be present to the player before the player activates the game trigger 716, after the player activates the game trigger 716 or after game execution but before the timer of the current cashless time game session. Such points 1802 at which the player is offered an additional wagering opportunity may be called "exit points." According to embodiments of the present invention, whether or not the player avails him or herself of the additional wagering opportunity, game play may thereafter resume from the exit point from the additional wagering opportunity was offered, without loss of continuity or context in the primary game, as shown at 1805 in FIG. 18. According to other embodiments, the player may be returned to the primary game at some other point in the game. Such may be the case, for example, in which the additional wagering opportunity offers the player an alternate route (or strategy) through the game narrative, in addition to an opportunity to bet on some aspect of the alternate route. In that case, it will be expected that the player will be returned to the primary game at some point other that at the exit point from which the additional wagering opportunity was offered.

According to further embodiments, the primary game timer (see step 734) may be halted for the duration necessary to offer and act upon the additional wagering opportunity, so as not to affect the value of the intermission. According to other embodiments, the primary game timer 734 is unaffected by the detour the player takes by availing him or herself of the offered additional wagering opportunity or opportunities, which does, by definition, affect the intermission and the wager, which is a function of the intermission (see step 740) in the current cashless time game session.

As shown in FIG. 18, from any of the exit points 1802, the player may be presented within an additional wagering opportunity, and the premise thereof (e.g., will the dragon's breath incinerate the bunny rabbit frolicking in the nearby meadow?) set out for the player's consideration. As shown at 1804, it is determined whether the additional wagering opportunity timer is equal to zero (or has otherwise timed out). For example, the user may be given a predetermined period of time, such as 10 seconds, to decide whether to bet or to pass on the offered additional betting opportunity. If the additional wagering opportunity timer has not timed out yet, the player may be requested to choose whether to bet or to not bet on the offered additional wagering opportunity, as shown at 1806. If, however, the additional wagering opportunity timer has reached zero or has otherwise timed out, step 1805 calls for the player to be returned to the primary game at the exit point (or to some other point, according to the game's script). As shown at 1808, the wager of the additional wagering opportunity is calculated, either as a function of the intermission (as a function of the time elapsed since last game or bet) or as a fixed (gaming machine determined: "Bet $5?" or "No Bet") or alternatively still as a player determined bet (e.g., player places a $1 chip token on the "Bet" button). Chip based gaming machines and methods, of the type in which a player places a chip token of a predetermined value on a betting opportunity, are disclosed in commonly assigned application Ser. No. 11/409,722, filed Apr. 24, 2006, now U.S. Pat. No. 7,371,173, which is hereby incorporated herein by reference in its entirety. The outcome of the additional wagering opportunity may then be randomly generated and rendered to the gaming machine's display(s). This outcome need not be displayed immediately, but may instead be woven into the primary game's narrative. The player's available credits may then be credited or debited, according to whether the wagered outcome occurred or not, in known fashion.

Figure 19:
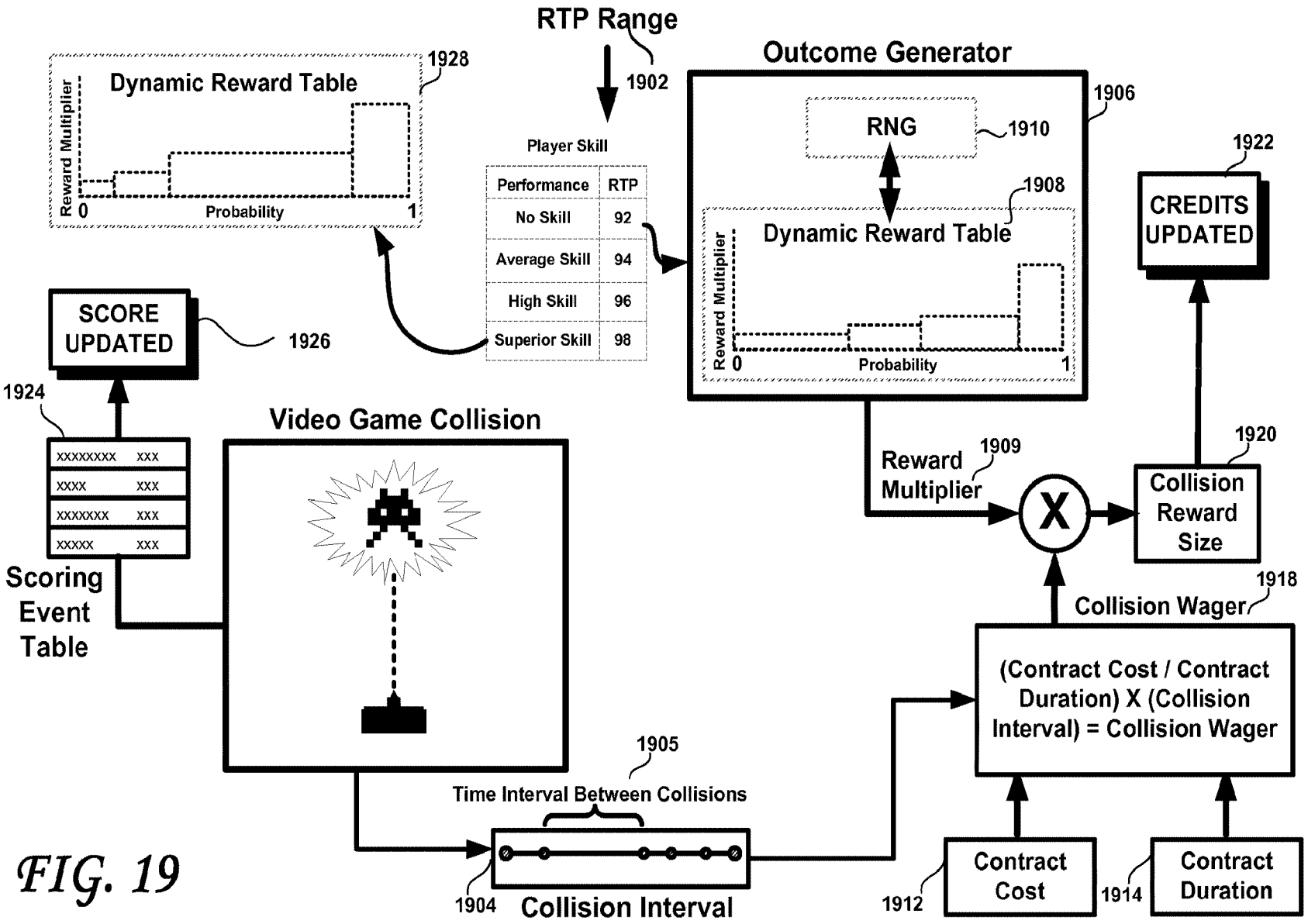
FIG. 19 demonstrates how time-based casino games with skill wagering opportunities may employ a dual accounting system in which interactions with reward generating or penally inducing assets within a casino video game lead to updates of both the player's video game score and the player's credit balance, according to further embodiments of the present invention.

FIG. 19 shows how time-based casino games with skill wagering opportunities according to embodiments of the present invention may employ a dual accounting system in which successful interactions with reward generating assets or interactions with penally inducing assets (assets may be selectively reward generating and penalty inducing, depending upon the player's interaction therewith) occurring within a casino video game lead to updates of both the player's video game score and the player's credit balance.

According to embodiments of the present invention, players may initiate game play of a time-based casino game featuring dual accounting by purchasing a game contract for a predetermined duration of game play for a predetermined price. The duration and price of that contract determines the value of each unit of time (e.g., seconds or fractions thereof). This dynamic is described in FIG. 5, where the accompanying text outlines a scenario in which a player purchasing a 2 hour game contract for $100 would play with a wager factor (i.e. the monetary value per unit of time) of $0.0139 cents per second. It should be noted, however, that casino games featuring dual accounting according to embodiments of the present invention may have a progressive jackpot associated therewith that may be funded by setting aside a portion of the price paid by the player for the game play contract. In this case, the formula to determine the wager factor (value per unit of time) in casino video games with dual accounting according to embodiments of the present invention may be stated as follows: (contract price−portion of contract price set aside for funding the progressive jackpot)/contract duration=wager factor. In other words, the value per unit of time, according to embodiments of the present invention, may be calculated by dividing that portion of the game play contract cost that is not set aside for the progressive jackpot by the predetermined duration of the purchased game play contract.

The game play contract cost, duration, and resulting wager factor may constitute the key inputs into casino games featuring dual accounting, as these elements are used to determine how many credits the player will be awarded when he or she successfully interacts with reward generating assets within the game. As those of skill may also recognize, these elements may also be used to determine how many credits the player may lose when he or she interacts with penalty inducing assets during game play. Alternatively, the player may only lose time (that is, lose the ability to successfully interact with reward generating assets during that time) when he or she interacts with a penalty inducing asset. A reward generating asset may be thought of as any feature within a regulated video game that causes the player's score and/or credit balance to increase upon a successful interaction therewith. According to embodiments of the present invention, whenever the player's score increases, a wager may be placed that has the potential to increase the player's credit balance. For example, a reward generating asset in a space-based video game may be an alien spacecraft, and a successful interaction with such a reward generating asset may be or include destroying the alien spacecraft. In a video pinball game, an example of a reward generating asset may be a bumper and a successful interaction therewith may be the player's ball colliding with the bumper. To return to the space-based game genre, an example of a penally inducing asset may be an alien torpedo and an interaction therewith would be the alien spacecraft's torpedo killing the player's spacecraft, through failure of the player to avoid being hit thereby. In a video pinball game, a penalty inducing asset may be the ball return passageway between the two lower flippers (commonly referred to as the drain) and an interaction therewith would be the player's ball falling therein, leading to the penalty of losing the ball and/or the associated time delay until a new ball is released (if any new balls are available). According to embodiments of the present invention, as the player engages in casino video game play, whenever he or she successfully interacts with any or selected reward generating assets, a wager may be executed. This paradigm is described more fully in the scenario in FIG. 13 in which a cowboy (the player) must attempt to successfully interact with a bomb (an example of an asset that can be either reward generating or penally inducing, depending on whether the player successfully diffuses the bomb and is rewarded or is blown up by the bomb and is consequently penalized). Returning to FIG. 19, to randomly determine the wager placed as a result of successfully interacting with the onscreen reward generating asset (in this case, shooting down the alien spacecraft), the value of the time interval 1905 between successful interactions (e.g., collisions or other forms of interactions shown in FIG. 10 as Collision Interval 1904) may be determined and then referenced against a wagering event pay table 1908 and a random number generator 1910 to determine the player's credit reward 1910.

In greater detail, games according to the embodiments of the present invention may come pre-configured on a regulated gaming machine or may be configured to use an operator configurable average Return-to-Player (RTP) percentage range. Operator configured games self-adjust to return an operator-input percentage of funds to the player and hold the rest for the house. Players may be scored on how they perform various tasks within the game, with the game using those player scores to determine where its actual average RTP percentage will fall within its preset average RTP percentage range 1902 (e.g., from 92% to 98%). For example, in a game with a preset average RTP percentage range of 92-98%, a player exhibiting no or minimal skill may cause the game to payout at the game's minimum 92% average RTP percentage, while a player exhibiting superior skill may cause the game to payout at the game's maximum payout percentage of 98%. It is important to note that, while lower-skilled players are assigned a lower average RTP percentage in this model, they still have an opportunity to win in a particular gaming session because of the game's inherent randomness—it is still a game of chance.

According to embodiments of the present invention, once a game is assigned a preset average RTP percentage range and has determined which player skill grade is applicable (some games, according to further embodiments, may not use skill based grading while others, according to further embodiments, may default to an average player skill grade until the player has played long enough to for the gaming machine to assign an average RTP percentage corresponding to his or her individual skill level), this data may be input into the Outcome Generator 1906. The Outcome Generator 1906 may perform at least two functions: the generation of dynamic reward tables 1908 and random number generation through a Random-Number-Generator (RNG) 1910. Dynamic reward tables 1908 assign specific wagering properties to in-game reward generating assets appearing within a game according to embodiments of the present invention. Note that not all game assets within a game need be configured as being reward generating. Whenever the player encounters, collides or otherwise interacts with those assets (i.e., when the player's Pacman® eats a bonus cherry (an example of a reward generating asset) or the player's pinball hits a bumper (another example of a reward generating asset)), a dynamic reward table for the award generating asset with which the player has collided (or with which the player has otherwise successfully interacted) may be referenced by a random number output from an RNG 1910 and a corresponding reward multiplier 1909 is output. That is, the RNG 1910 generates a random number between 0 and 1 and that randomly generated number is used as a reference or index into the dynamic reward table 1908 for that reward generating asset (and for that determined or initial RTP) and the corresponding reward multiplier 1909 is read from the table. Note that different assets may be associated with different dynamic reward tables.

As shown, the dynamic reward table 1908 may be configured to assign a predetermined reward multiplier 1909 for specific ranges between 0 and 1. Within the dynamic reward table 1908, the widest range may be associated with the lowest reward multiplier, with progressively narrower ranges being associated with progressively higher reward multipliers. However, the dynamic reward tables 1908 may be configured with as little or as much variability (e.g., the difference between the lowest reward multiplier and the highest reward multiplier) as desired. Note that a dynamic reward table 1908 may be generated (or a pre-stored dynamic reward table retrieved from memory) for each RTP range 1902. Indeed, players exhibiting no or low skill may be assigned an average RTP percentage of, for example, 92 which may be associated with a dynamic reward table 1908 that tends to generate, on average, lower reward multipliers than a dynamic reward table 1908 that is associated with a comparatively greater average RTP percentage of, for example, 98. That is, players exhibiting greater skill may be assigned an average RTP percentage of, for example, 98 and that average RTP percentage may be associated with a dynamic reward table (such as shown at 1928 in FIG. 19) that returns, on average, larger reward multipliers 1909 than would the dynamic reward table 1908 associated with a comparatively lower average RTP percentage (such as the dynamic reward table 1908 that is shown to be associated with the average RTP percentage of 92). As may be seen in comparing the dynamic reward tables 1928 and 1908, the dynamic reward table 1928 for the higher average RTP percentage is configured (in this case, skewed) to return greater reward multipliers, on average, than the dynamic reward table 1908, as the probability ranges for the lower reward multipliers in the dynamic reward table 1928 are comparatively narrower than the corresponding and comparatively wider probability ranges for the lower reward multipliers in the dynamic reward table 1908.

Interactions with penalty-inducing assets may be handled in a similar manner, with a collision penally size (the negative counterpart of the collision reward size 1920) causing credits to be deducted from the player's balance or simply resulting in a predetermined time penally (recall that each unit of time has a predetermined value) in which the player is enable to successfully interact with the reward generating assets and increase his or her score and increase his or her credit balance. Such may, for example, take the form of a predetermined period of time to regenerate the player's canon (space-based game), provide a new ball (video pinball game) or other icon or avatar. A predetermined time penally floor may be pre-established, so the player is not penalized more than a predetermined period of time during any one game. In this manner, even players exhibiting no discernable skill may still successfully interact with reward generating assets during the game, place wagers and win credits.

According to an embodiment of the present invention, the reward multiplier 1909 output from the outcome generator 1906 may be used in conjunction at least with the wager size to determine the size of the player's financial reward for each collision or interaction (or successful collision or interaction) with a reward generating asset within a regulated game according to embodiments of the present invention.

Several key factors may determine the size of the player's wager and, by extension, the player's reward when upon a successful interaction with a reward-generating asset. According to embodiments of the present invention, players may initiate a game by purchasing a time-based contract. Each second of that contract has a value that may be expressed by dividing the contract cost 1912 by the contract duration 1914. For example, a 60 second contract that costs $6.00 has a contract value of 10 cents per second. According to embodiments of the present invention, once the value of time within the contract has been internally calculated, the size of a collision wager may be calculated by multiplying the value of time within the contract by how much time has elapsed since the last collision. Therefore, the formula for determining a collision wager may be expressed, according to one embodiment of the present invention, as (Contract Cost/Contract Duration)×(Collision Interval)=Collision Wager 1918. The collision reward size 1920 may then be determined by multiplying the collision wager 1918 by the reward multiplier 1909 output by the outcome generator 1906 in the manner described above. The player's credits may then be updated, as shown at 1922. It is to be understood FIG. 19 shows but one exemplary method of determining the player's reward upon successfully interacting with a reward generating asset. Other methods of randomly determining such rewards are possible and are deemed to fall within the purview of the present inventions, as determined by the appended claims.

FIG. 19 shows a collision in which a cannon destroys a space ship in a Space Invaders® themed game 1912. Successful collisions in the present dual accounting model could represent any number of video game events including but not limited to the player's car passing a milestone or competitor's car in an automobile racing themed game, a player scoring a basket in a basketball themed game, or the player's Pacman® eating a power pellet in a Pacman® themed game.

In addition to earning the player a credit reward, the collision depicted in FIG. 19—the player's cannon destroying a spacecraft—also earns the player a score, hence the dual accounting nature of embodiments of the present invention. With respect to game play, this score generating processes may be configured to work no differently than it would in a standard console (e.g., a Sony game console, a Microsoft game console, or a Nintendo game console) or arcade game. The collision event (the cannon destroying the approaching alien spacecraft) causes the game to reference a scoring event pay table 1924 to determine the point value associated with that event (for example, hitting alien spacecraft=1,000 points and destroying alien spacecraft=5,000 points). Then, the point value that is found from consulting the event pay table 1924 is awarded to the player and the player's score is updated, as shown at 1926. In contrast to a conventional console or arcade game, however, that point value contributes to a final score that may qualify the player to win money via a progressive jackpot. This jackpot may be funded by a portion (e.g., a predetermined percentage) of the player's contract price, as described above. At the end of a predetermined period that is set by the casino (i.e. an hour, a day, a week, etc.), the player who has earned the highest score is awarded the jackpot. Or, alternatively, operators may configure the game such that the two highest scoring players share the jackpot in some predetermined manner. Alternatively, the game may be configured such that more than two players share the progressive jackpot. The process in which this jackpot may be awarded according to further embodiments of the present invention is illustrated in greater detail with respect to FIGS. 21 and 22. The player or players having earned the highest scores (on this regulated gaming machine or across multiple regulated gaming machines) may be recognized by the gaming machine after the predetermined period with a video presentation, an audio flourish or other form of recognition (such as a printed certificate, for example), to celebrate the players' achievement in earning the high score.

Figure 20:
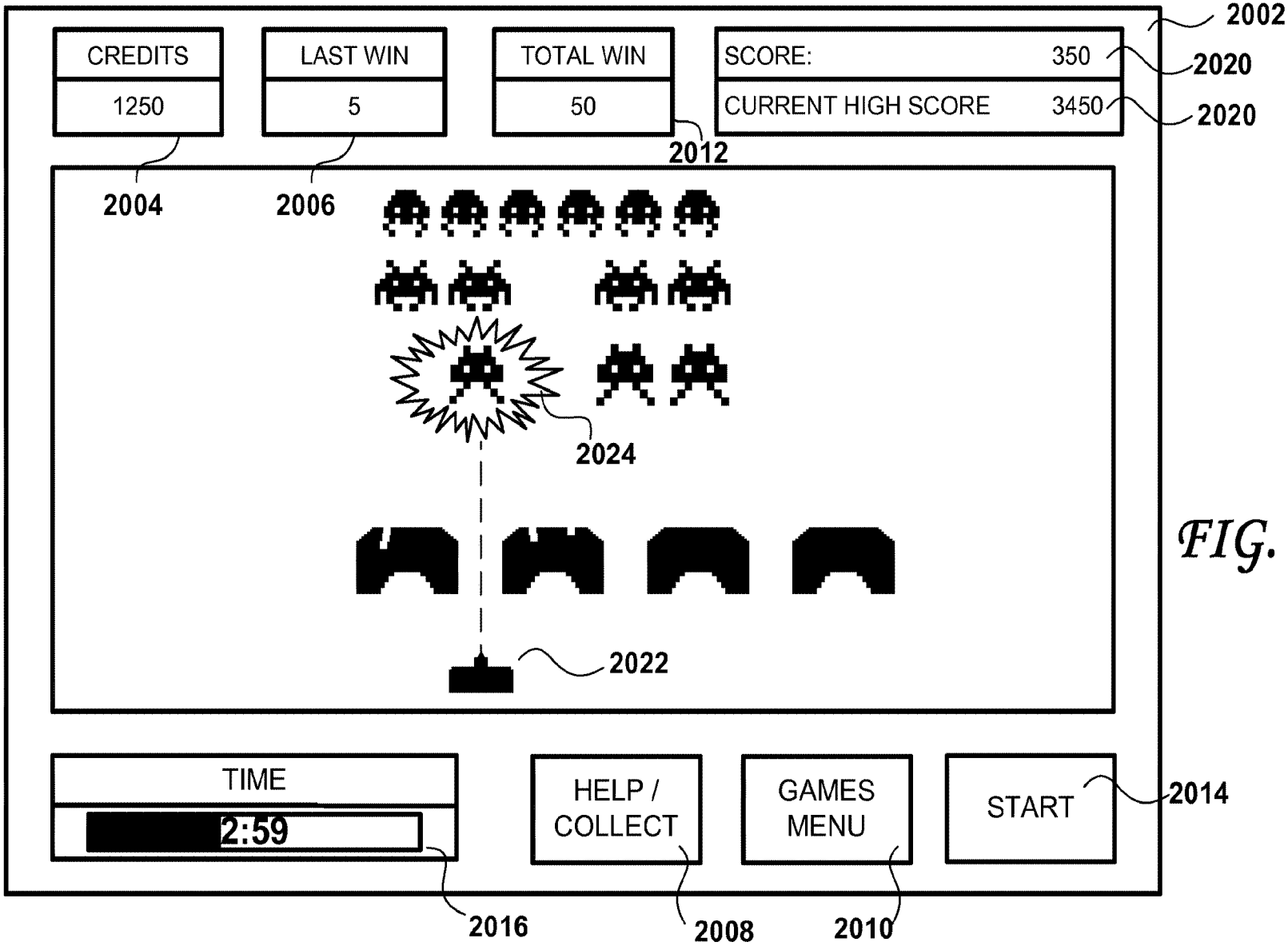
FIG. 20 shows one exemplary user interface for a time-based casino game with skill wagering opportunities featuring dual accounting, according to embodiments of the present invention.

FIG. 20 depicts one exemplary user interface for a time-based casino game with skill wagering opportunities featuring dual accounting, according to further embodiments of the present invention. As may be seen, the conventional console or arcade game may be modified, as shown in the user interface 2002, to the extent necessary to include both traditional betting meters such as CREDITS 2004, LAST WIN 2006, HELP/COLLECT 2008, and MENU 2010 as well as meters specific to the present embodiments such as TOTAL WIN 2012 (which may read, alternatively, CONTRACT WIN). The TOTAL WIN meter displays how many credits the player has won during the current gaming contract. In addition, the depicted gaming screen features a START button 2014 which may be used to initiate game play on a purchased game play contract. Pressing the START button 2014 causes a clock meter 2016 to begin to tick down. The game may also display meters such as SCORE 2020 and HIGH SCORE 2020 meters to alert players of their progress in competing for the game's high-score progressive jackpot feature. The arcade or console games modified in this manner may also be played in multi-player mode, in which the game session of the respective players lasts for an amount of time determined by respective credits of playing time of the plurality of players.

The player may engage in primary game play on a game with dual accounting without having to make any modifications to the strategy or methods he or she would use to play a conventional video game. For example, in the depicted game, the player may maneuver his cannon 2022 in an attempt to evade enemy fire and to destroy the fleet of aliens that are advancing towards him. As the player's cannon successfully shoots down an alien as shown at 2024, or as the player is successful in performing any other key in game event, the player's score 2020, credits won as a result of the last successful interaction (LAST WIN button 2006), the total number of credits won during this game (TOTAL WIN button 2012) and the player's credit balance (CREDITS button 2004) may be updated using, for example, the logic outlined relative to FIG. 19.

In should be noted the betting model described in FIG. 20 works best in jurisdictions that allow automatic bets (auto-bets) to be made. A particularly advantageous embodiment of the invention allows these wagers to occur automatically whenever successful interactions with reward generating assets occur during game play (i.e., during the predetermined duration of the purchased game play contract). However, in jurisdictions where auto-betting is not allowed, the game may pause briefly to obtain the player's prior authorization to make a wager whenever the player successfully interacts with a reward generating asset in the game.

Figure 21:
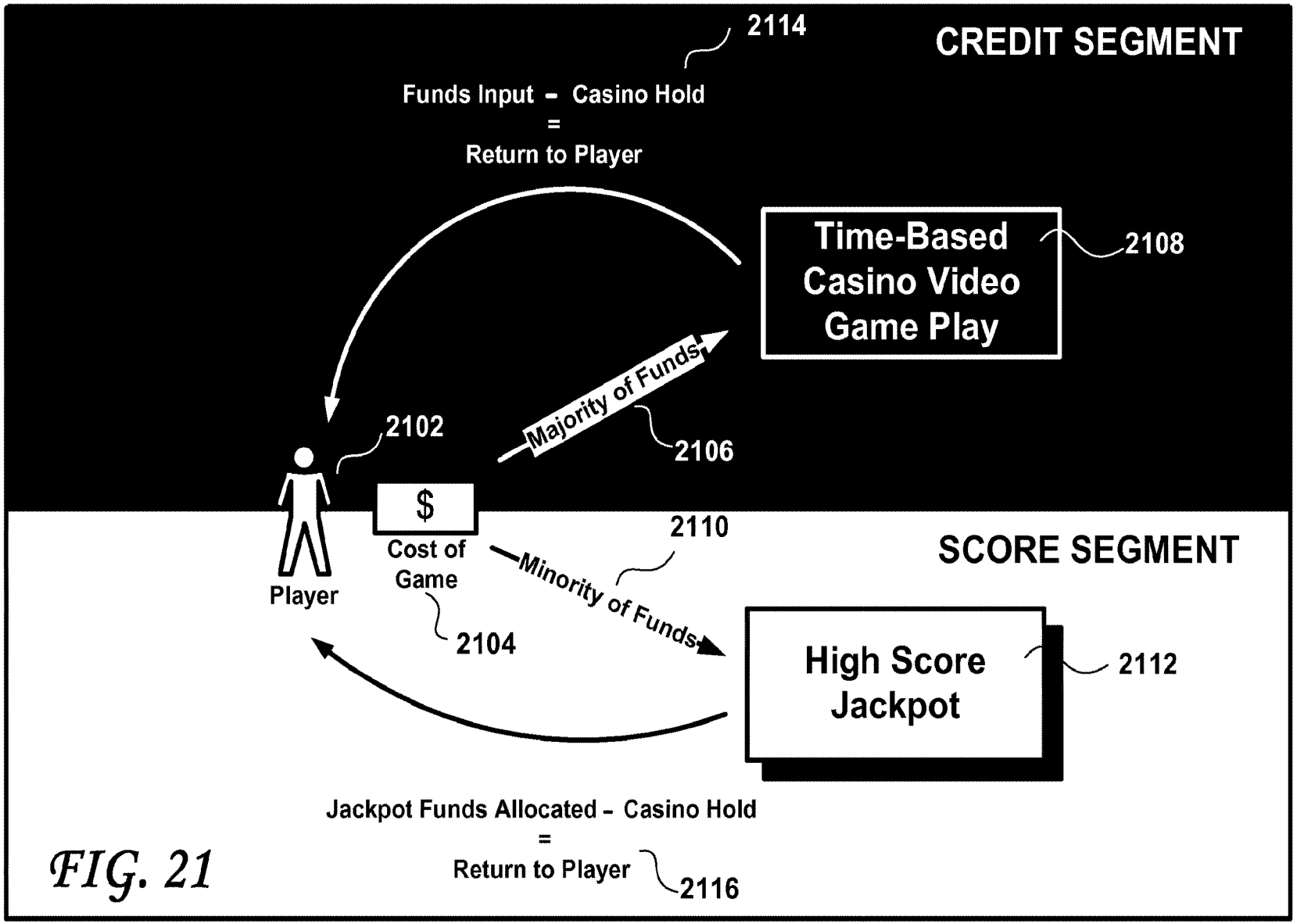
FIG. 21 shows how funds may be allocated, wagered, and returned in a time-based casino game featuring dual accounting according to embodiments of the present invention.

FIG. 21 demonstrates how funds may be allocated, wagered, and returned in a Time-based casino game featuring dual accounting, according to embodiments of the present invention. When the player 2102 makes the decision to wager his funds 2104 in a time-based casino video game featuring dual accounting (by purchasing a time-based contract to play the game for a predetermined amount of time in exchange for a predetermined amount of money), his or her funds are divided, with the vast majority 2106 (such as, for example, over 90%) being allocated to fund the primary game 2108 (such as the aforementioned skill-based games).

As the player engages primary game play, the game's clock continues to run until time has expired, signaling the end of the game. Successful interactions occurring with reward generating assets within a game session—often in the form of in-game collisions—cause the player to earn: a) a score and b) credits and/or fractional credits that may be cashed out at the end of that session. Credits may be awarded via the random process described in FIG. 19 that takes the player's wager factor and an event specific pay table as its key inputs. This element of dual accounting game play is referenced by the shaded CREDIT SEGMENT portion of FIG. 21.

In parallel, a minority (e.g., a small portion) of the funds wagered by the player 2110 (10%, for example) may be allocated to the game's high score progressive jackpot 2112. These funds may be pooled with the jackpot-allocated funds of all other players playing the same gaming machine or class of game within a predetermined period of time (i.e. the jackpot duration) and awarded at the end of that jackpot duration to the player or players with the highest score or scores. The length of each jackpot may be operator configurable such that operators may offer jackpots that expire each week, each day, each hour, etc. The time of day in which a jackpot expires in this model (i.e., the time at which one high score progressive jackpot ends and another begins) may also be defined by the casino to generate maximum activity on its gaming machines. For example, a casino that sees its highest level of customer traffic at noon may wish to define noon as the end of one of its high score progressive cycle so that as many players as possible will be contending to win a progressive jackpot. This element of dual accounting game play is referenced by the non-shaded SCORE SEGMENT portion of FIG. 21.

When played optimally, the primary game may return funds, on average, to the player using the formula: Funds Input−Casino Hold=RTP 2114 and the secondary game returns funds to the player using the formula: Jackpot Funds Allocated−Casino Hold=RTP 2116.

Figure 22:
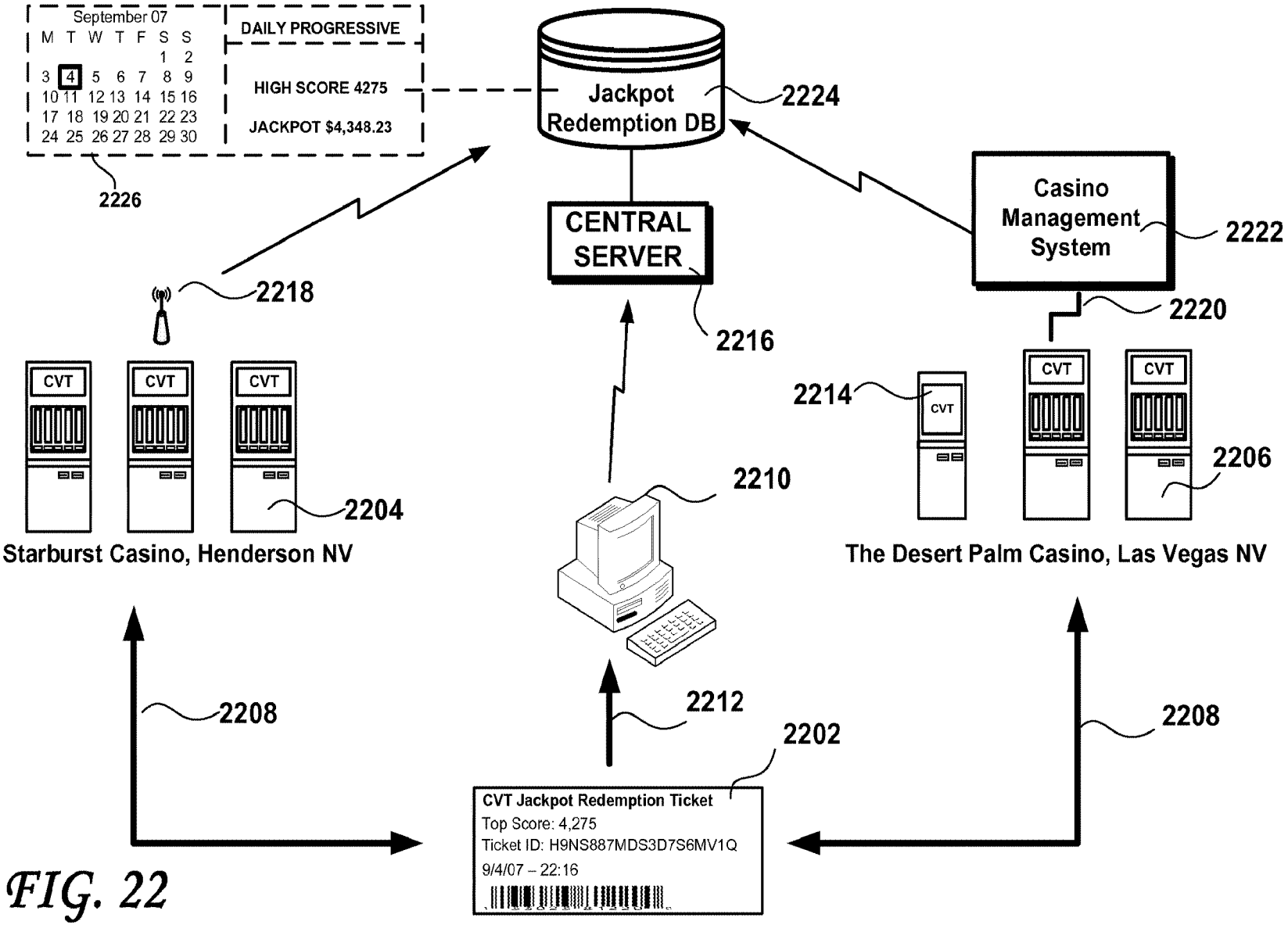
FIG. 22 illustrates how high score progressive jackpot tickets may be issued and checked in a casino network offering time-based casino games that feature dual accounting according to embodiments of the present invention.

FIG. 22 illustrates how high score progressive jackpot tickets may be issued and checked in a casino network offering time-based casino games featuring dual accounting according to embodiments of the present invention. Time-based casino games featuring dual accounting may be configured to offer high score progressive jackpots. In this process, whenever a player earns the highest score on a regulated gaming machine, he or she may be issued a jackpot redemption ticket 2202 or any other functionally equivalent ticket or device. FIG. 22 shows how gaming machines at multiple locations such as, for example, the Starburst Casino in Henderson, Nev. 2204 and The Desert Palm Casino in Las Vegas, Nev. 2206 may be networked together to establish a common jackpot pool. In this implementation, the gaming machines offering the present time-based casino games featuring dual accounting may be configured to both issue and check the status of jackpot redemption tickets, as suggested by the arrows shown in FIG. 22 at reference numeral 2208. Players checking a winning ticket may be issued cash, or a ticket representing the cash value of the jackpot (or their portion thereof).

In addition, if the game operators wish to make such a feature available, the status of jackpot redemption tickets may be checked at a player's home using a personal computer 2210 and an internet connection. In this scenario, players wishing to check the status of a ticket may enter a code printed on the ticket into a web site dedicated for that purpose, as suggested at 2212. In some embodiments of the invention described herein, the players holding winning tickets may return to the casino and enter their ticket into a participating machine to receive their award. In other embodiments, players may have the funds mailed to their home in the form of a check or have the funds transferred to an account in their name electronically. In yet another model, players may check and redeem tickets using dedicated kiosks 2214 located on the casino floor.

In the redemption model depicted, information regarding the status of each high score jackpot may be stored within a central jackpot server 2216. Gaming machines on each floor may be coupled to the central jackpot server wirelessly 2218 or through a wired connection 2220, optionally via a participating casino's casino management system 2222. The central jackpot server may include or may be coupled to a jackpot redemption database 2224 in which critical information 2226 about each day's jackpot may be organized, for example, by calendar day and stored therein. Such critical information may include, for example, the size of the jackpot, the daily high score, and all of the scores, codes, game info, and timestamps associated to jackpot redemption tickets issued on each particular day.

While the enclosed figure details a network comprising of two casinos in one U.S. state, the network may readily be scaled to include larger networks comprising a plurality of casinos in many states. Moreover, according to further embodiments of the present inventions, gaming networks that span country and continental boundaries are also possible.

Progressive jackpots may also apply across families of games, such that a player wagering on a dual accounting Space Invaders® game may compete against a player wagering on a dual accounting Super Mario Bros.® game for a common progressive reward. Such a feature is made possible by standardizing the scoring using a performance index such that player performance may be meaningfully and fairly compared across different families of games.

While the foregoing detailed description has described preferred embodiments of the present invention, it is to be understood that the above description is illustrative only and not limiting of the disclosed invention. Those of skill in this art will recognize other alternative embodiments and all such embodiments are deemed to fall within the scope of the present invention. Thus, the present invention should be limited only by the claims as set forth below.

The invention is claimed as follows:

1. A gaming system comprising:
at least one display device;
at least one input device;
at least one processor; and
at least one memory device that stores instructions that, when executed by the at least one processor, cause the at least one processor to:
prior to a play of a skill-based game:
determine a skill level of a player;
determine, based on the determined skill level of the player and independent of any skill levels of any other players, one of multiple different return-to-player percentages to employ for the play of the skill-based game by the player, wherein a first return-to-player percentage is determined when the skill level is a first skill level and a second return-to-player percentage different from the first return-to-player percentage is determined when the skill level is a second skill level different from the first skill level;
thereafter, cause the at least one display device to display the play of the skill-based game to the player in accordance with the determined return-to-player percentage, the play of the skill-based game being associated with receipt, via the at least one input device, of at least one skill-based input made by the player; and
responsive to a score increase event that occurs in association with the play of the skill-based game:
modify a score of the player, wherein the score of the player is separate from a credit balance of the player, and
cause the at least one display device to display the modified score.

2. The gaming system of claim 1, wherein the first skill level is higher than the second skill level and the first return-to-player percentage is higher than the second return-to-player percentage.

3. The gaming system of claim 1, wherein the instructions, when executed by the at least one processor, cause the at least one processor to determine a duration for the play of the skill-based game based on an amount wagered for the play of the game.

4. The gaming system of claim 1, wherein the instructions, when executed by the at least one processor, cause the at least one processor to, if the score of the player exceeds a high score upon completion of the play of the skill-based game, cause the score of the player to be set as the high score and cause a redemption ticket to be provided to the player, the redemption ticket redeemable for a designated award at a later point in time if the score of the player is still the high score at that later point in time.

5. The gaming system of claim 4, wherein the later point in time is an end of a predetermined interval.

6. The gaming system of claim 4, wherein the designated award is at least partially funded by wagers placed on plays of the skill-based game.

7. A method of operating a gaming system, the method comprising:
prior to a play of a skill-based game:
determining, by at least one processor, a skill level of a player;
determining, by the at least one processor, based on the determined skill level of the player and independent of any skill levels of any other players, one of multiple different return-to-player percentages to employ for the play of the skill-based game by the player, wherein a first return-to-player percentage is determined when the skill level is a first skill level and a second return-to-player percentage different from the first return-to-player percentage is determined when the skill level is a second skill level different from the first skill level;

thereafter, causing a display, by at least one display device, of the play of the skill-based game to the player in accordance with the determined return-to-player percentage, the play of the skill-based game being associated with receipt of at least one skill-based input made by the player; and responsive to a score increase event that occurs in association with the play of the skill-based game, modifying, by the at least one processor, a score of the player and causing a display, by the at least one display device, of the modified score, wherein the score of the player is separate from a credit balance of the player.

8. The method of claim 7, wherein the first skill level is higher than the second skill level and the first return-to-player percentage is higher than the second return-to-player percentage.

9. The method of claim 7, further comprising determining, by the at least one processor, a duration for the play of the game based on an amount wagered for the play of the skill-based game.

10. The method of claim 7, further comprising, responsive to the score of the player exceeding a high score upon completion of the play of the skill-based game, causing, by the at least one processor, the score of the player to be set as the high score and causing, by the at least one processor, a redemption ticket to be provided to the player, the redemption ticket redeemable for a designated award at a later point in time if the score of the player is still the high score at that later point in time.

11. The method of claim 10, wherein the later point in time is an end of a predetermined interval.

12. The method of claim 11, wherein the designated award is at least partially funded by wagers placed on plays of the skill-based game.

13. The method of claim 7, which is at least partially provided through a data network.

14. The method of claim 13, wherein the data network is an internet.

15. A gaming system comprising:

at least one processor; and at least one memory device that stores instructions that, when executed by the at least one processor, cause the at least one processor to:

prior to a play of a skill-based game:

determine a skill level of a player;

determine, based on the determined skill level of the player and independent of any skill levels of any other players, one of multiple different return-to-player percentages to employ for the play of the skill-based game by the player, wherein a first return-to-player percentage is determined when the skill level is a first skill level and a second return-to-player percentage different from the first return-to-player percentage is determined when the skill level is a second skill level different from the first skill level;

thereafter, communicate data which results in a display device displaying the play of the skill-based game to the player in accordance with the determined return-to-player percentage, the play of the skill-based game being associated with receipt of at least one skill-based input made by the player; and responsive to a score increase event that occurs in association with the play of the skill-based game:

modify a score of the player, wherein the score of the player is separate from a credit balance of the player, and communicate data which results in the display device displaying display the modified score.

16. The gaming system of claim 15, wherein the first skill level is higher than the second skill level and the first return-to-player percentage is higher than the second return-to-player percentage.

17. The gaming system of claim 15, wherein the instructions, when executed by the at least one processor, cause the at least one processor to determine a duration for the play of the game based on an amount wagered for the play of the skill-based game.

18. The gaming system of claim 15, wherein the instructions, when executed by the at least one processor, cause the at least one processor to, if the score of the player exceeds a high score upon completion of the play of the skill-based game, cause the score of the player to be set as the high score and cause a redemption ticket to be provided to the player, the redemption ticket redeemable for a designated award at a later point in time if the score of the player is still the high score at that later point in time.

19. The gaming system of claim 18, wherein the later point in time is an end of a predetermined interval.

20. The gaming system of claim 18, wherein the designated award is at least partially funded by wagers placed on plays of the skill-based game.

* * * * *